US007699181B2

(12) United States Patent
Torro

(10) Patent No.: US 7,699,181 B2
(45) Date of Patent: Apr. 20, 2010

(54) STORAGE APPARATUS AND METHOD OF USE

(75) Inventor: Danilo Torro, Los Angeles, CA (US)

(73) Assignee: Rakku Inc., Los Angeles, CA (US)

( * ) Notice: Subject to any disclaimer, the term of this patent is extended or adjusted under 35 U.S.C. 154(b) by 584 days.

(21) Appl. No.: 11/666,560

(22) PCT Filed: Jan. 17, 2007

(86) PCT No.: PCT/US2007/001167

§ 371 (c)(1),
(2), (4) Date: Apr. 27, 2007

(87) PCT Pub. No.: WO2007/084521

PCT Pub. Date: Jul. 26, 2007

(65) Prior Publication Data

US 2009/0223911 A1 Sep. 10, 2009

Related U.S. Application Data

(60) Provisional application No. 60/760,028, filed on Jan. 17, 2006.

(51) Int. Cl.
*A47F 7/08* (2006.01)

(52) U.S. Cl. ..... 211/37; 211/131.2; 211/164; 211/184; 220/529; 220/530

(58) Field of Classification Search ..... 211/34, 211/37, 38, 131.2, 164, 184, 78; 312/135, 312/327; 220/507, 529, 530, 531, 534
See application file for complete search history.

(56) References Cited

U.S. PATENT DOCUMENTS

| | | | | |
|---|---|---|---|---|
| 1,867,145 | A * | 7/1932 | Godfrey | 211/164 |
| 2,082,088 | A * | 6/1937 | Wilson | 211/34 |
| 3,693,806 | A * | 9/1972 | Lit et al. | 211/70 |
| 3,784,024 | A * | 1/1974 | Kristy | 211/131.2 |

* cited by examiner

*Primary Examiner*—Korie Chan
(74) *Attorney, Agent, or Firm*—Mind Law Firm; Jeromye V. Sartain

(57) ABSTRACT

A storage apparatus and method involves a wheel storage assembly having adjustable pockets for storage therein of an article. The wheel storage assembly generally includes a pocket assembly and opposite wheel assemblies. The pocket assembly may include a core, at least two dividers installed in an offset relationship on the core, the dividers being configured to project substantially radially outwardly from the core to form a free end of each divider, and a clip mounted at the free end of each divider. A base assembly may be employed to rotatably support the wheel storage assembly. A hub of each wheel assembly may be formed with an outer, substantially rounded surface and with a tension belt installed on a base connector of the base assembly and looped around the rounded surface to control the rotational speed of the wheel storage assembly as mounted on the base assembly.

24 Claims, 18 Drawing Sheets

STORAGE APPARATUS AND METHOD OF USE

RELATED APPLICATIONS

This application claims priority to and is entitled to the filing date of U.S. Provisional application Ser. No. 60/760,028 filed Jan. 17, 2006, and entitled "Shoe Storage System." The contents of the aforementioned application are incorporated herein by reference.

INCORPORATION BY REFERENCE

Applicant hereby incorporates herein by reference any and all U.S. patents and U.S. patent applications cited or referred to in this application.

TECHNICAL FIELD

Aspects of this invention relate generally to storage systems, and more particularly to an apparatus and method for storing a variety of articles within adjustable compartments.

BACKGROUND ART

In the art, a number of different racks, bins, pockets, and the like have been proposed in a variety of contexts for storing various kinds of articles, whether stand-alone or configured to be mounted on a wall, piece of furniture, or as part of a closet storage system.

The prior art described above teaches such racks, bin, pockets, and the like, but does not teach a storage apparatus and method involving a wheel storage assembly having adjustable pockets for storage therein of an article. Aspects of the present invention fulfill this need and provide further related advantages as described in the following disclosure.

DISCLOSURE OF INVENTION

Aspects of the present invention teach certain benefits in construction and use which give rise to the exemplary advantages described below.

The present invention is generally directed to a storage apparatus and method involving a wheel storage assembly having adjustable pockets for storage therein of an article.

An aspect of the present invention may then be generally described as a base assembly and a wheel storage assembly mounted on the base assembly.

A further aspect of the present invention may be generally described as a pair of base connectors and a pair of frames removably mounted on the pair of connectors to form the base assembly.

A still further aspect of the present invention may be generally described as a pocket assembly and a pair of wheel assemblies installed in offset and substantially parallel relationship about the pocket assembly to form the wheel storage assembly.

A still further aspect of the present invention may be generally described as a core, at least two dividers installed in an offset relationship on the core, the dividers being configured to project substantially radially outwardly from the core to form a free end of each divider, and a clip mounted at the free end of each divider to form the pocket assembly.

A still further aspect of the present invention may be generally described as a hub and a rim attached to the hub to form the wheel assembly.

A still further aspect of the present invention may be generally described as each hub being formed with an outer, substantially rounded surface and with a tension belt installed on a base connector of the base assembly and looped around the rounded surface to control the rotational speed of the wheel storage assembly as mounted on the base assembly.

Other features and advantages of aspects of the present invention will become apparent from the following more detailed description, taken in conjunction with the accompanying drawings, which illustrate, by way of example, the principles of aspects of the invention.

BRIEF DESCRIPTION OF DRAWINGS

The accompanying drawings illustrate aspects of the present invention. In such drawings.

MODES FOR CARRYING OUT THE INVENTION

The above described drawing figures illustrate aspects of the invention in at least one of its exemplary embodiments, which are further defined in detail in the following modes.

The subject of this patent application is an improved storage apparatus generally comprising a base assembly and a wheel storage assembly mounted on the base assembly and having adjustable pockets for storage therein of an article. As will be appreciated by those skilled in the art, and in view of following detailed description of various embodiments, while particular constructions of the storage apparatus are shown and described, the invention is not so limited. Rather, numerous other configurations or combinations of the components, both now known or later developed, may be employed in the present invention without departing from its spirit and scope. Specifically, it will be appreciated that while the wheel storage assembly is shown as having a curved body and as being mounted on a base assembly, even these features are not necessary in practicing the invention.

Figure 1:
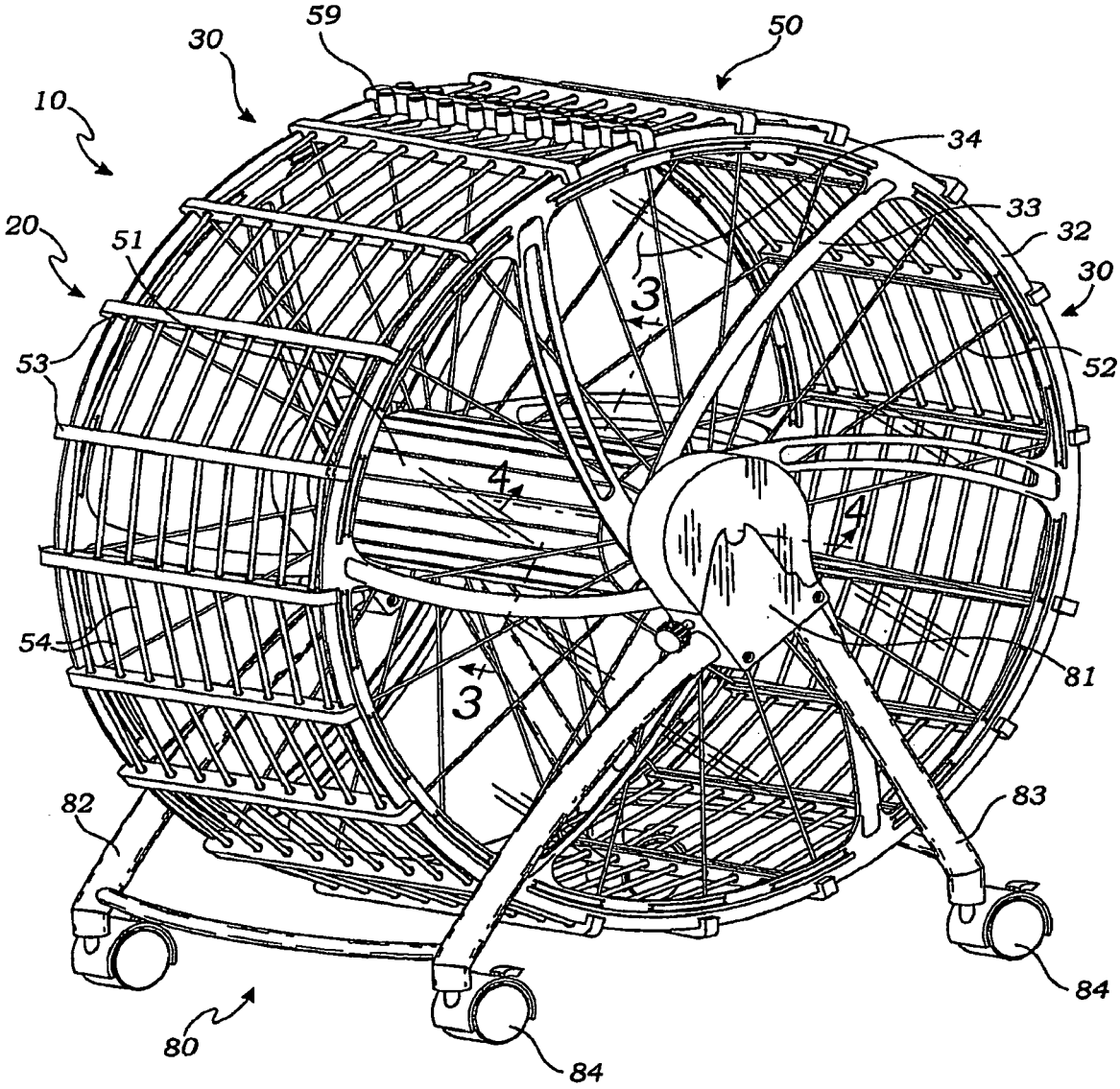
FIG. 1 is a perspective view of an exemplary embodiment of the storage apparatus of the present invention.
Figure 2:
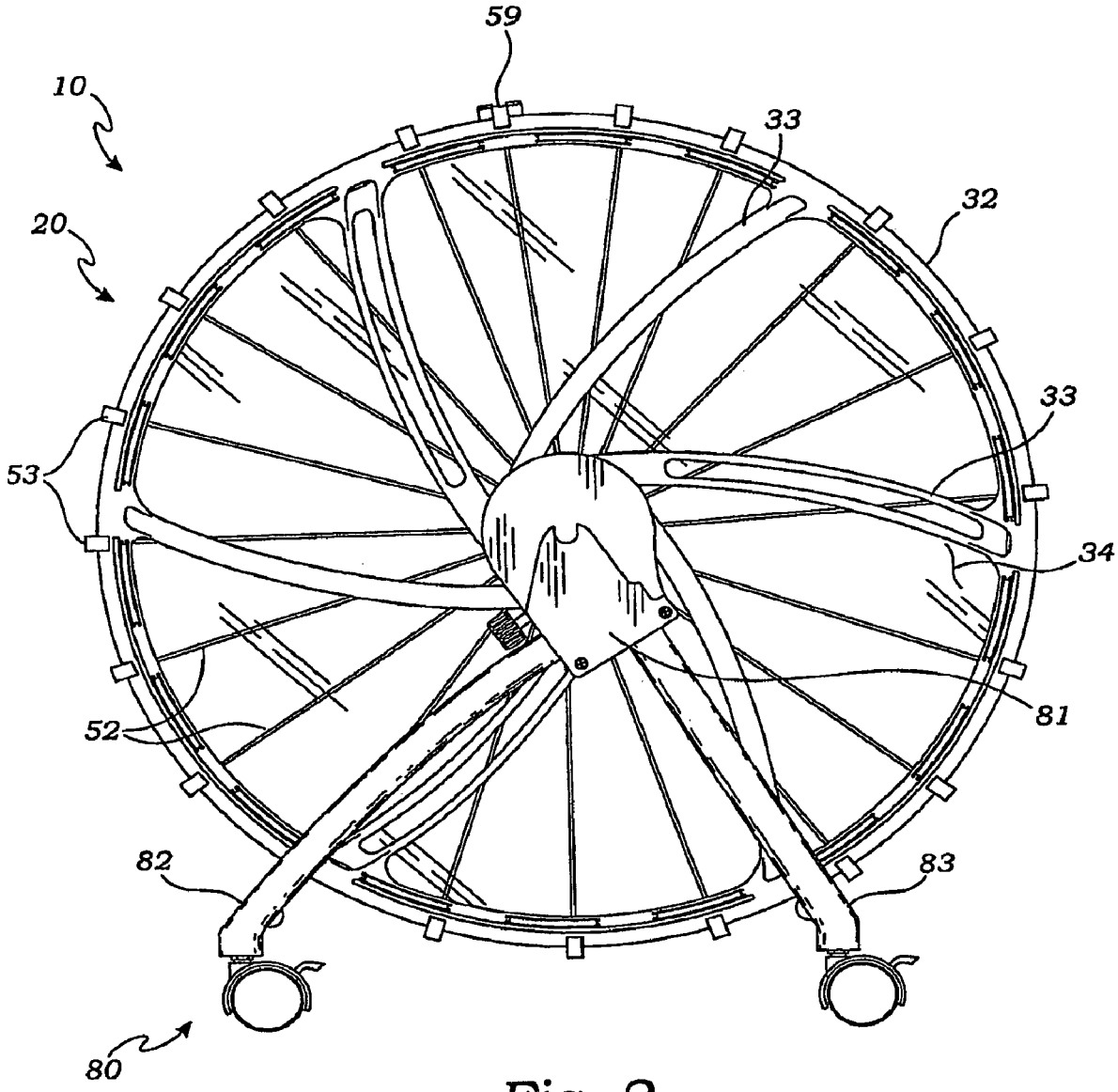
FIG. 2 is side view thereof.

Referring first to FIG. 1, there is shown a perspective view of an exemplary embodiment of the storage apparatus 10 having a wheel storage assembly 20 removably mounted on a base assembly 80, each of which will be explained in terms of its components and sub-assemblies in greater detail below. Generally, the wheel storage assembly 20 itself includes opposing, spaced-apart, substantially parallel wheel assemblies 30 on which a pocket assembly 50 is effectively suspended as assembled. Each wheel assembly 30 generally comprises a central hub 31 (FIGS. 4, 7 and 8A) connected to a perimeter rim 32 by one or more spokes 33, with a panel 34 attached along the rim 32 and substantially covering the area between the rim 32 and the hub 31. The wheel assemblies 30 are held in their opposing, spaced-apart, substantially parallel arrangement by one or more connecting rods 35 (FIGS. 3, 4 and 8A) joining the wheel assemblies 30 through their respective hubs 31. The pocket assembly 50 generally comprises a core 51 through which the one or more connecting rods 35 of the wheel storage assembly 20 passes and from which multiple dividers 52 project substantially radially outwardly and terminate in clips 53 that then engage the rims 32 of the respective wheel assemblies 30 to removably mount the pocket assembly 50 on the wheel assemblies 30, with the core 51 effectively suspended about the connecting rods 35, to form the unitary wheel storage assembly 20 and thereby further maintain the spatial relationship between the opposing wheel assemblies 30 by virtue of the connecting clips 53 spaced thereabout Elastic cords 54 pass through the clips 53 so as to selectively contain any items placed in the storage apparatus 10, and particularly within the pockets bounded on front and back by adjacent dividers 52, left and right by opposite panels 34 installed on the respective wheel assemblies 30, and at the bottom by the core 51, more about which is said below in connection with FIG. 10 and the storage apparatus 10 in use. With continued reference to FIG. 1, the completed wheel storage assembly 20 is rotatably installed on the base assembly 80 to form the storage apparatus 10. The base assembly 80 includes a pair of base connectors 81 in which the wheel storage assembly 20 is mounted and a pair of frames 82, 83 removably mounted in the base connectors 81. Casters 84 may be installed on the frames 82, 83 to render the resulting storage apparatus 10 further mobile. Once again, those skilled in the art will appreciate that numerous other configurations of the storage apparatus 10 beyond the exemplary embodiment are possible without departing from the spirit and scope of the invention. For example, as best shown in FIG. 2, although the wheel assemblies 30 are shown as a circular wheel having a hub 31 (FIGS. 4, 7 and 8A) with several spokes 33 connected to a rim 32 and lined with a transparent panel 34, each wheel assembly 30 may be any other shape such as semicircular, polygonal, etc., any other size, with or without spokes, or formed or lined with any transparent or opaque materials, fabric, plastic, metal or wood. Specifically, while each wheel assembly 30 is shown as having six substantially equally-spaced, somewhat curved radial spokes 33, alternating solid and slotted, it will be appreciated that this construction is merely illustrative and that the invention is not so limited. Moreover, each hub, spoke and rim sub-assembly, though shown and described as a unitary construction, as by being a molded plastic or being machined, cut, stamped or otherwise formed from a single piece of material such as plastic, metal or wood, may also be formed of separate components that are then assembled in a subsequent step. Similarly, and by way of further example, it will be appreciated that although the base assembly 80, and particularly the frames 82, 83, is shown as having a tubular, curved shape and of modular construction, the base assembly 80 may instead be any suitable material, such as plastic or metal, or shape and its construction can be a one-piece, unitary welded or molded assembly. Thus, for any of these components and sub-assemblies making up the storage apparatus 10, virtually any configurations or materials or methods of construction now known or later developed may be employed without departing from the spirit and scope of the invention. With continued reference to FIG. 2, while a total of twenty dividers 52 and clips 53 are shown, and thus twenty distinct adjustable storage areas or pockets therebetween, it will be appreciated that this is also merely illustrative and that the storage apparatus 10 can easily be scaled up or down, again, in a variety of configurations, to accommodate various kinds, sizes and quantities of articles.

Figure 3:
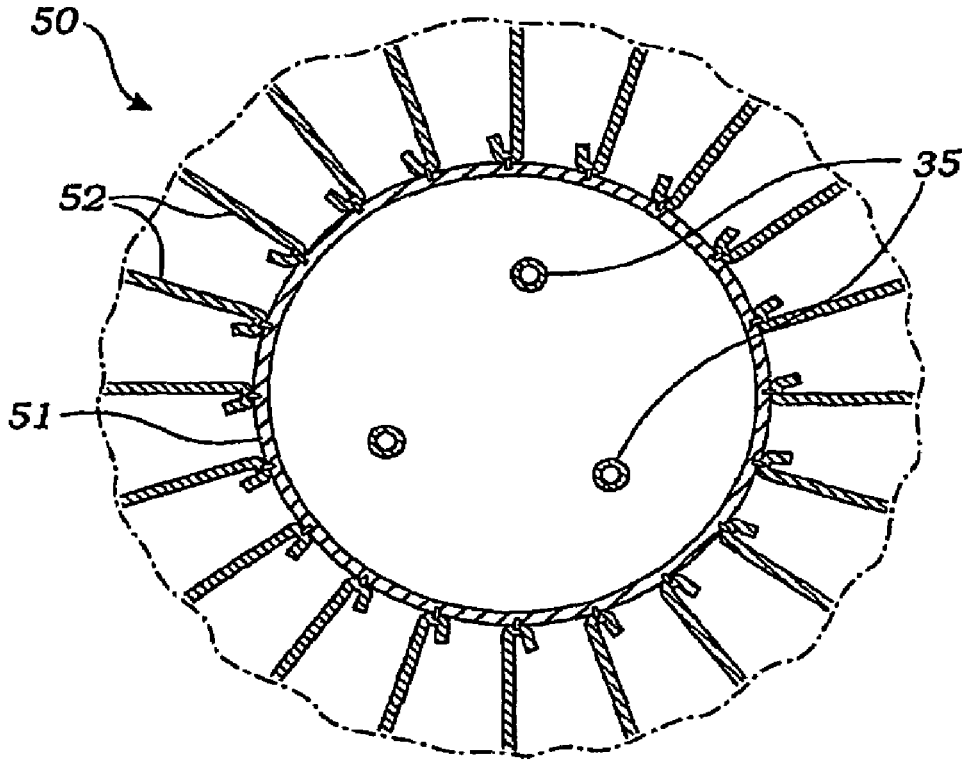
FIG. 3 is a partial, enlarged cross-sectional view thereof taken along line 3-3 of FIG. 1.
Figure 8A:
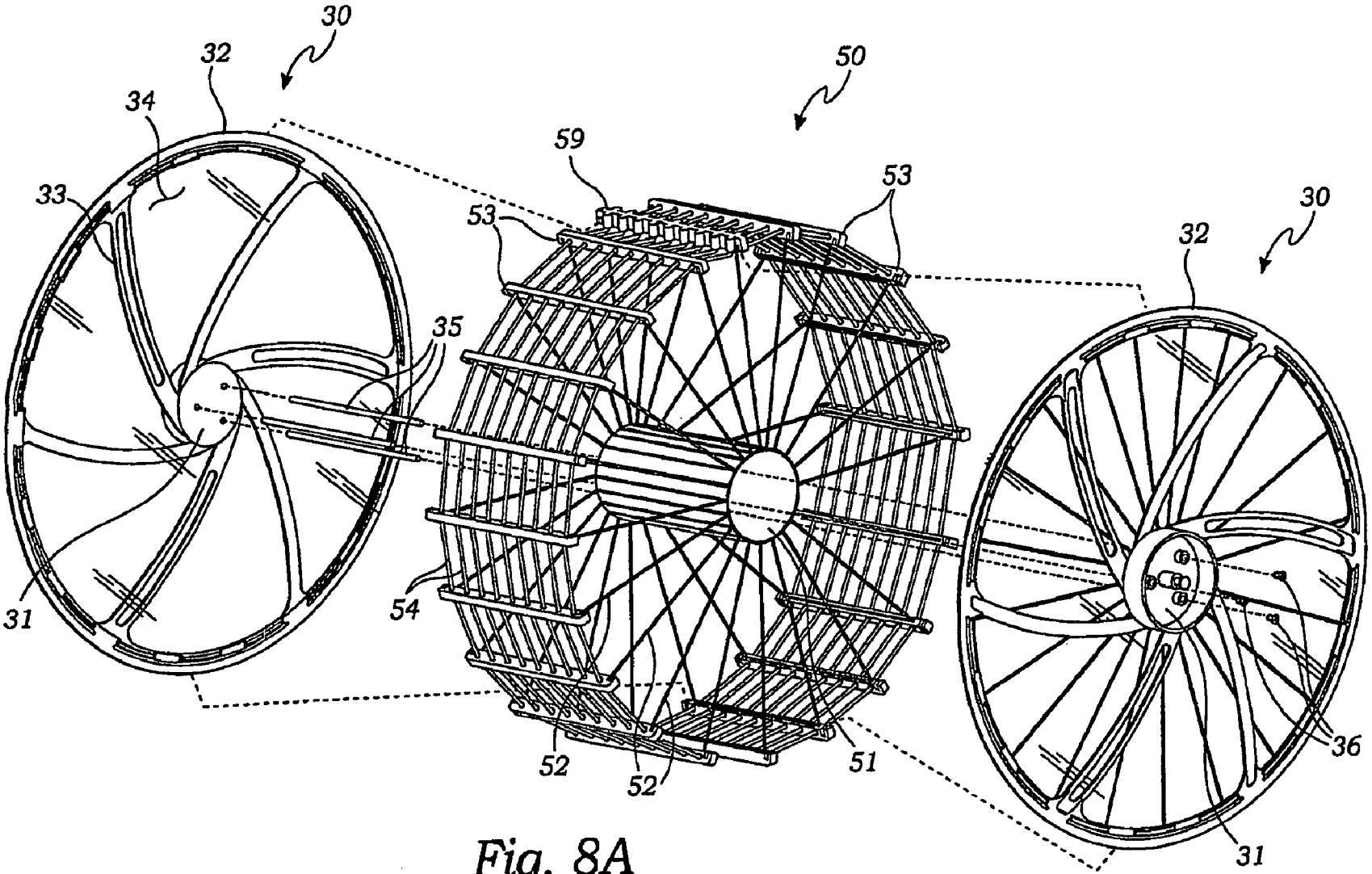
FIG. 8A is an exploded view of a first assembly configuration of the exemplary embodiment of FIG. 1.

Turning now to FIG. 3, there is shown a partial cross-sectional view of the pocket assembly 50 showing that the several dividers 52 are stitched, welded, crimped bonded or otherwise attached to the outer surface of the center core 51. While the core 51 can be any material such as plastic, wood or metal, in the exemplary embodiment the core 51 is made of a relatively elastic fabric or textile material so as to provide tension on each of the dividers 52 as they are mounted at their opposite free ends to the rims 32 of the respective wheel assemblies 30 through the clips 53, more about which is said below. As such the dividers are folded at their ends adjacent to the core and there tacked to the core as through a stitch. Once more depending on the materials of both the dividers and the core, a number of other assembly techniques now known or later developed may be employed in attaching the dividers to the core, either permanently or removably. As also seen in FIG. 3, with the pocket assembly 50 installed on the wheel assemblies 30 to form the wheel storage assembly 20 as shown in FIGS. 1 and 2, such that the elastic core 51 is effectively symmetrically pulled in equal and opposite radial directions substantially around its entire perimeter, the core 51 is thus held in a substantially annular shape, with a hollow annular space formed therein. In this annular space, and substantially parallel the axis of the core 51 pass the one or more connecting rods 35. While in the exemplary embodiment there are three such rods 35, as also shown in FIG. 8A, it will be appreciated by those skilled in the art that this number is merely illustrative and that the present invention can be practiced with a lesser or greater number of rods than the three shown and described, requiring only the corresponding modification of the wheel hubs 31 to provide the appropriate number of mounting holes.

Figure 4:
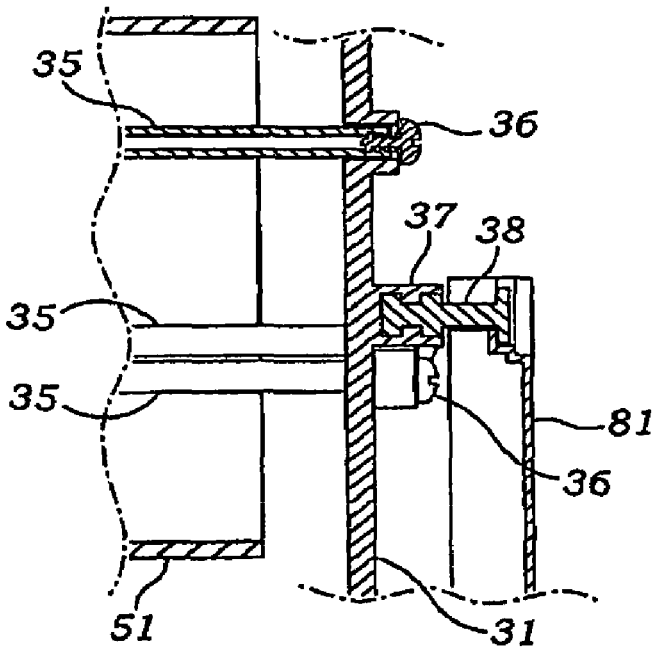
FIG. 4 is a partial, enlarged cross-sectional view thereof taken along line 44 of FIG. 1.

Turning now to FIG. 4, there is shown a partial cross-sectional view through one end of the core 51 of the pocket assembly 50 with the connecting rods 35 again passing through the hollow center of the core 51 and now mounted in a hub 31 of a wheel assembly 30. As can be seen in this view, in the exemplary embodiment the connecting rods 35 are hollow tubes threaded at each end so as to receive a screw 36 passing through a corresponding mounting hole formed in the hub 31. It will be appreciated that the rods 35 may also be solid with the appropriate hole for receiving the screw 36 drilled and tapped in each end. Or, it will be further appreciated that the rods 35 could be configured, whether as solid or hollow, to be joined with each hub 31 as through a press or interference fit, a weld, solvent or ultrasonic or high frequency bonding, or any other such fastening technique now known or later developed, and depending on the materials of construction of both the rods 35 and the hubs 31. Thus, while in the exemplary embodiment the rods are formed of steel or aluminum and the hub is an injection-molded plastic, it will be appreciated that numerous other materials now known or later developed may be used. Specifically, the rods 35 may be metal, plastic, wood or any other such material now known or later developed. With further reference to FIG. 4, the hub 31 is shown as having a central outwardly-extending boss 37 in which is installed an outwardly-extending pivot pin 38. In the exemplary embodiment, the pin 38 is formed with a notched shoulder onto which the hub 31, and the boss 37 particularly, is over-molded, whereby the pin 38 is effectively formed integral with hub 31 with the protruding flanged tip 45 for rotatably mounting each wheel assembly 30 on the respective base connector 81 as described in more detail below in connection with FIG. 7 and the assembly view of FIG. 8B. Once more, those skilled in the art will appreciate that the pin 38 may be installed on or formed integral with the hub 31 in a number of ways beyond that shown and described without departing from the spirit and scope of the invention. For example, the pin 38 may instead be press fit or screwed into the hub 31, may be bonded or welded to the hub 31, may be formed of unitary material and construction with the hub 31, as through a molding or machining technique, or may be formed on an axle rod 76 that itself passes between both opposing hubs 31 through the core 51, as in the alternative embodiment of FIGS. 11-16.

Figure 5:
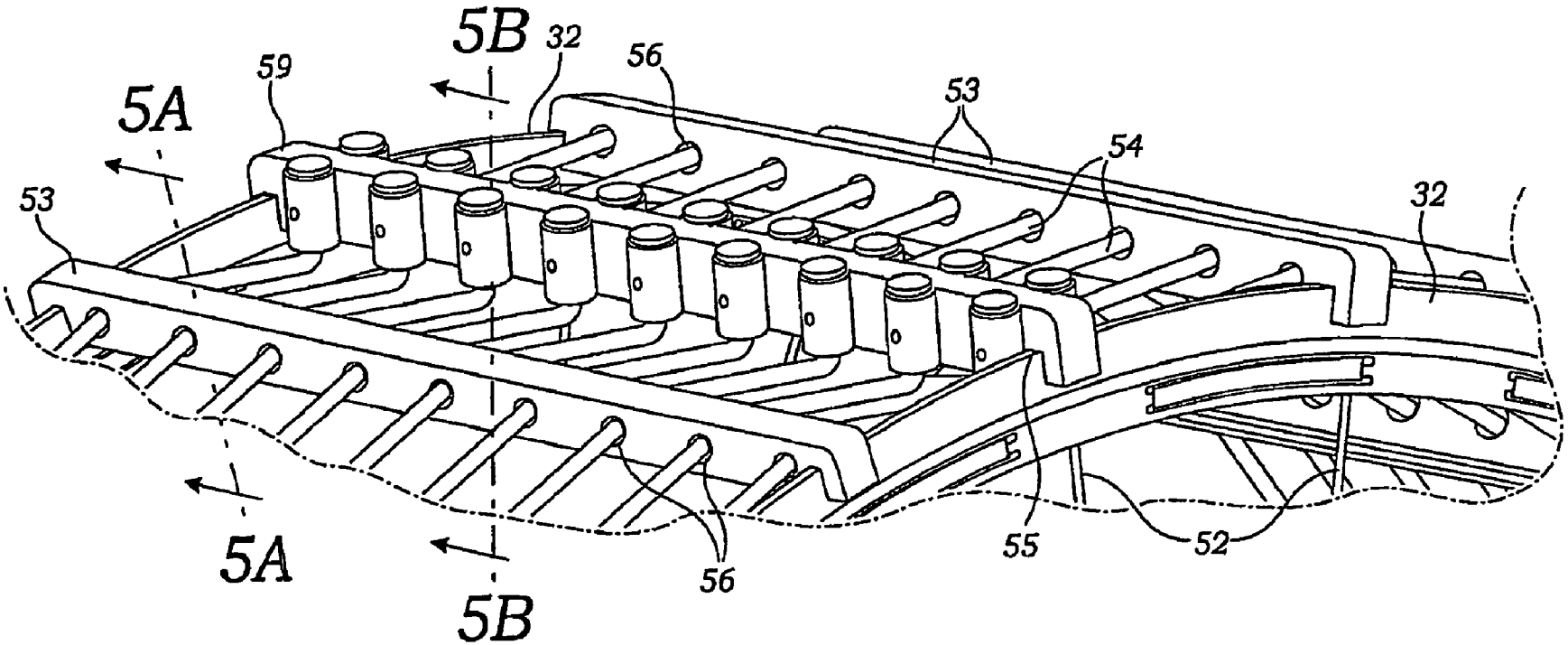
FIG. 5 is a partial, enlarged perspective view thereof.
Figure 5A:
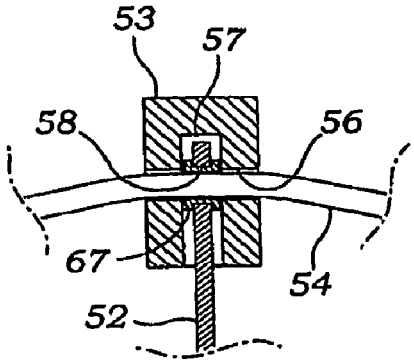
FIG. 5A is a partial, enlarged cross-sectional view thereof taken along line 5A-5A of FIG. 5.
Figure 5B:
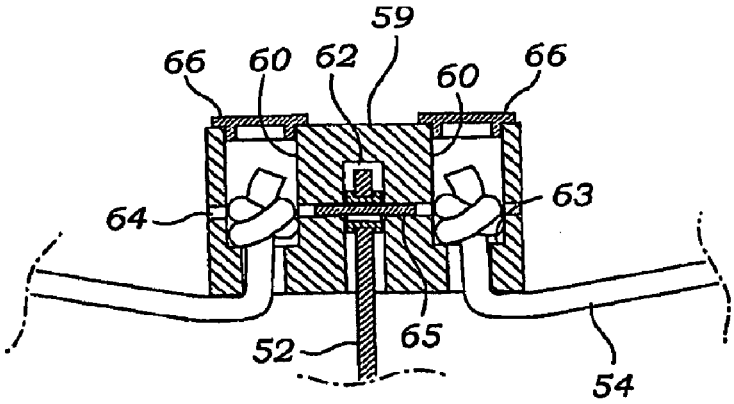
FIG. 5B is a partial, enlarged cross-sectional view thereof taken along line 5B-5B of FIG. 5.

Referring now to FIG. 5, there is shown an enlarged partial perspective view of the opposite free ends of the dividers 52 as they terminate in corresponding offset clips 53 mounted along the rims 32 of the respective wheel assemblies 30. Specifically, the clips 53 are each formed with downwardly-opening notches 55 at opposite lateral ends configured to engage the radial outward edges of the rims 32, there held in place by tension from the core 51 and divider 52 sub-assemblies. Each clip 53 is further formed with a series of spaced-apart through-holes 56 corresponding to and allowing for the passage therethrough of the elastic cords 54. As such, the through-holes 56 serve to space the cords 54 about the perimeter of the wheel storage assembly 20 when it is assembled, more about which is said below in connection with the storage apparatus 10 in use. As best seen in FIG. 5A, an enlarged cross-sectional view of the typical clip 53 taken through one of the through-holes 56, a lengthwise slot 57 is also formed in the clip 53 extending substantially centrally through the body of the clip 53 up from its bottom so as to at least intersect the through-hole 56, the slot 57 being substantially perpendicular thereto. In this way, each divider 52 is formed at its end opposite the core 51 with a set of spaced apart holes 58 substantially corresponding to the through-holes 56 formed in the clips, whereby each divider 52 is inserted at its free end into the slot 57 of the corresponding clip 53 so that the divider holes 58 are substantially aligned with the clip through-holes 56. Thus, the cords 54 may then pass through each clip 53 as by passing through the aligned holes 56, 58 of the clip 53 and divider 52, respectively, thereby simultaneously locating the cords 54 in spaced apart relationship around the circumference of the wheel storage assembly 20 and also securing the dividers 52 within the clips 53. To further secure the dividers 53 and insure that they are not inadvertently torn or separated from the clips, metal or plastic eyelets 67 may be inserted in the divider holes 58 before the cords 54 are passed therethrough. Referring again to FIG. 5, along with FIG. 1, it can be seen that the cords 54 themselves thus pass around the entire circumference of the wheel storage assembly 20 by passing through each offset clip 53 in turn. It will be appreciated, though, that each cord 54 will typically terminate, or have a beginning and an end. While it is possible that the free opposite ends of a single cord 54 could simply be tied, bonded, welded, fused, sewn or otherwise attached one to another so as to complete each circular or looped cord 54, in the exemplary embodiment, the free opposite ends of each cord 54 terminate in a special anchor clip 59. As best shown in FIG. 5B, the anchor clip 59 is formed with opposite pairs of side holes 60 substantially about, offset from and parallel to a substantially central lengthwise slot 62 again securing the free end of the respective divider 52. In the exemplary embodiment of the anchor clip 59, the side holes 60 pass all the way through the anchor clip 59 and are counter bored from the top so as to have a stepped flange 63 substantially at the bottom of each side hole 60, or at the end of each side hole 60 closest to the divider 52 and core 51. Moreover, a cross-hole 64 is formed in the anchor clip 59 passing all the way therethrough substantially perpendicular to and intersecting both the side holes 60 and the central slot 62, whereby the divider 52 would be formed in much the same way as all other dividers in this exemplary embodiment, as shown and described in connection with FIG. 5A, and, upon insertion of the divider 52 into the slot 62 such that the holes 58 with eyelets 67 in the divider 52 are substantially aligned with the cross-hole 64, a cross-pin 65 may be inserted from either side of the anchor clip 59 through each cross-hole 64 so as to pin and secure the s divider 52 within the slot 62 of the anchor clip 59. Next, the opposite free ends of the elastic cord 54 are passed into the respective side holes 60 from the bottom and then knotted so as to be retained against the flange 63 formed at the bottom of each side hole 60. To conceal each side hole 60 and the knotted free end of the cord 54, after trimming any excess cord beyond the knot, a plug 66 or the like may then be inserted, as by a press or interference fit, into the open, upper end of each side hole 60. In an alternative exemplary embodiment, the offset side holes 60 may be formed in the anchor clip 59 from its bottom toward its top, though here not going all the way through the anchor clip 59. Instead, the free ends of the cord 54 are inserted into the respective side holes 60 until substantially bottoming at the top ends thereof and are there held in place by being cross-pinned as by a set screw or the like passing through the side wall of the anchor clip 59 into each side hole 60, as through the cross-hole 64. In any such embodiment, the divider 52 may be pinned as in FIG. 5B, or may be secured in the slot 62 of the anchor clip 59 as by an interference fit, solvent or ultrasonic welding or some other assembly technique. While certain exemplary embodiments of the clip assembly have thus been shown and described, it will be appreciated by those skilled in the art that various other configurations are possible without departing from the spirit and scope of the invention. Once again, various mechanical means now known or later developed may be employed for securing the opposite free ends of each cord 54 so as to form a continuous loop, as in the embodiment of FIG. 1, or other such shape, as in the alternative embodiment of FIG. 17, including but not limited to press or interference fits, solvent bonding, welding, sewing, and fusing. Furthermore, the different number of dividers 52 attached to the core 51 with the clips 53 to create discrete pockets of the storage apparatus 10 is virtually infinite, depending on the size and segmentation of the apparatus to suit a particular application. Each pocket divider sub-assembly including the divider 52, core 51 and/or clip 53 may be constructed as a one- or multi-piece assembly as by plastic injection, extrusion, or the like and may be flat or contoured and formed of a variety of materials, again, to suit a particular application. It will be further appreciated, particularly in view of the alternative exemplary embodiment of FIGS. 11-16, that the cords, while being substantially round in the exemplary embodiment, may also be flat bands, such that all of the through-holes 56 in the clips 53, or side holes 60 in the one anchor clip 59, and the cross-holes 58 in the dividers 52 may be formed as slotted rather than substantially round openings.

Figure 6A:
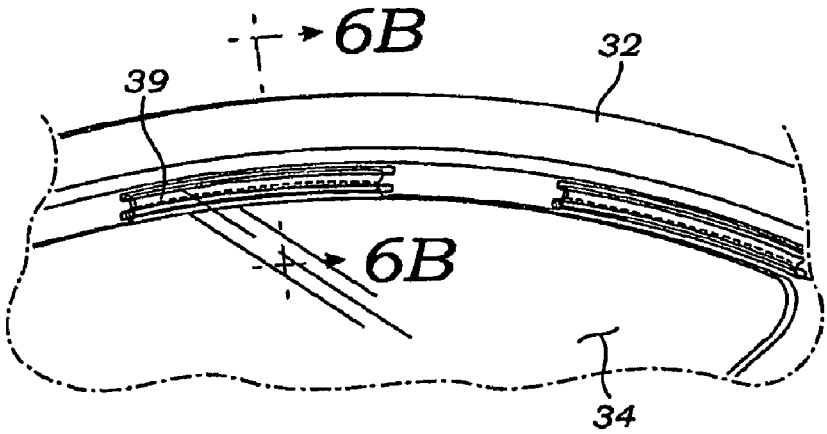
FIG. 6A is a partial, enlarged perspective view of the exemplary embodiment of FIG. 1.
Figure 6B:
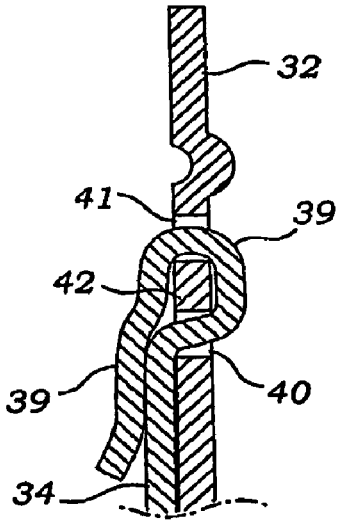
FIG. 6B is a partial, enlarged cross-sectional view thereof taken along line 6B-6B of FIG. 6A.

Turning to FIGS. 6A and 6B, there are shown enlarged partial perspective and cross-sectional views of the rim 32 of the wheel assembly 30. From these views it can be seen that the panel 34 is installed on the rim 32 as by being formed with spaced-apart radially-outwardly extending tabs 39 that pass through one or more corresponding arcuate slots 40, 41 formed along the rim 32. In the exemplary embodiment, two such slots 40, 41 are formed in an offset arrangement so that, as best shown in FIG. 6B, each tab 39 of the panel 34 may pass through a bottom slot 40 and then back through a top slot 41 so as to effectively be looped over the bar 42 formed between the two slots 40, 41. After passing through the two slots 40, 41 in this manner, the free end of the tab 39 may then be welded, bonded or otherwise secured to the front surface of the panel 34 and/or the back surface of the rim 32. In the exemplary embodiment, the assembly of the panel 34 to the rim 32 is accomplished through a sonic or high frequency weld of the tab 39 onto the panel 34, or back onto itself, though it will be appreciated by those skilled in the art that numerous other materials and methods of assembly are possible without departing from the spirit and scope of the invention. For example, a similar assembly could be accomplished through the use of a single slot 40 or even no slot by simply tack welding, solvent bonding, stitching, crimping or otherwise attaching the panel 34 to the rim 32 as by screws, hook-and-loop fasteners, snaps, or the like. Thus, it will be appreciated that the assembly shown and described is merely illustrative and that the invention is not so limited.

Figure 7:
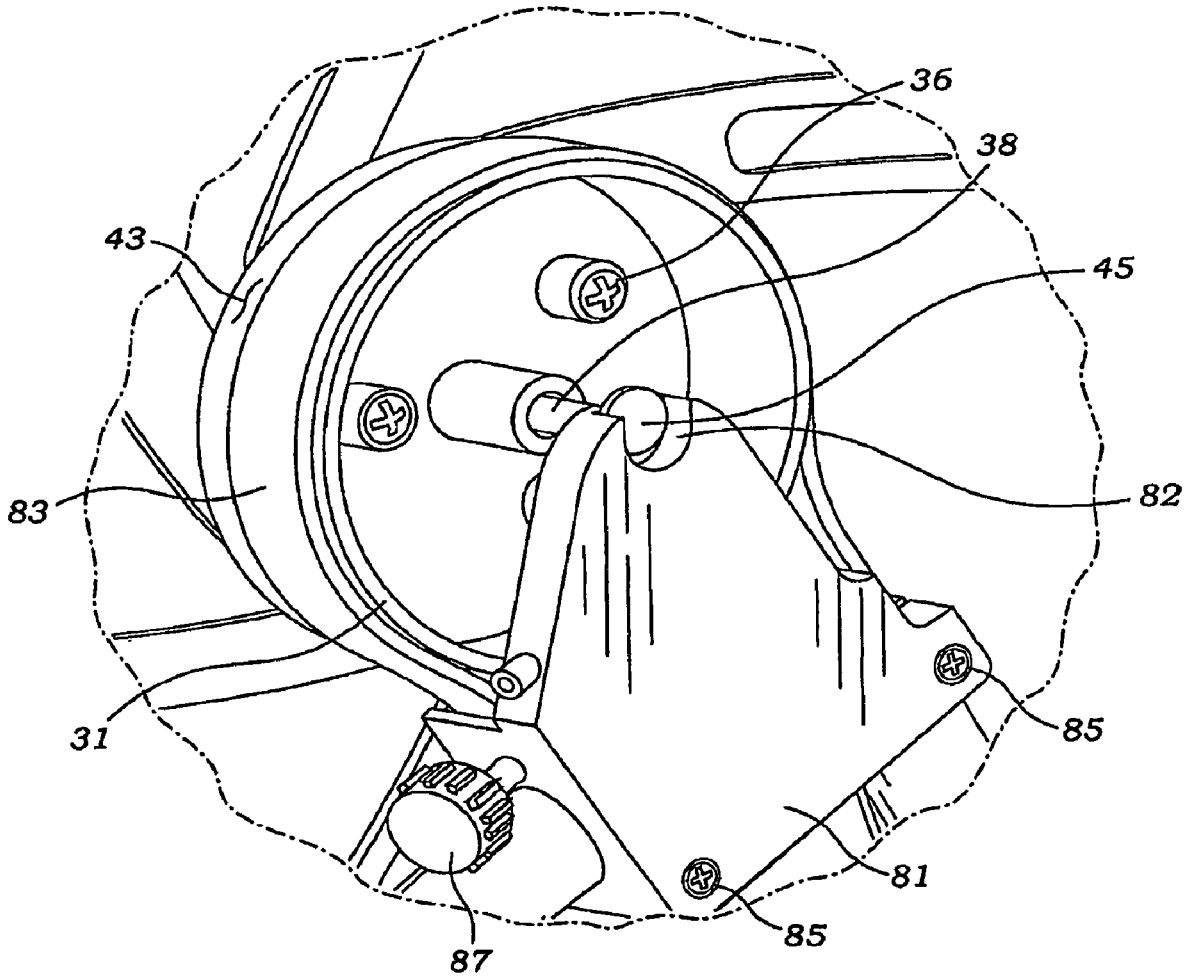
FIG. 7 is a partial, enlarged perspective view of the exemplary embodiment of FIG. 1.

Referring now to FIG. 7, there is shown an enlarged partial perspective view of the hub 31 of the wheel assembly 30 mounted in the base connector 81 of the base assembly 80 as by the pin 38. Specifically, the flanged head 45 of the pin 38 is seated in a corresponding substantially upwardly opening notch 82 formed on the base connector 81. As described in more detail below in connection with both the exploded assembly view of FIG. 8B and the storage apparatus 10 in use as shown in FIG. 10, a tension belt 83 installed on the base connector 81 and looped around an outer, substantially rounded surface 43 of the hub 31 has a dual purpose of controlling rotational speed of the wheel storage assembly 20 as mounted on the base assembly 80 and of keeping the wheel storage assembly 20 nested in place on the base assembly 80.

Figure 8B:
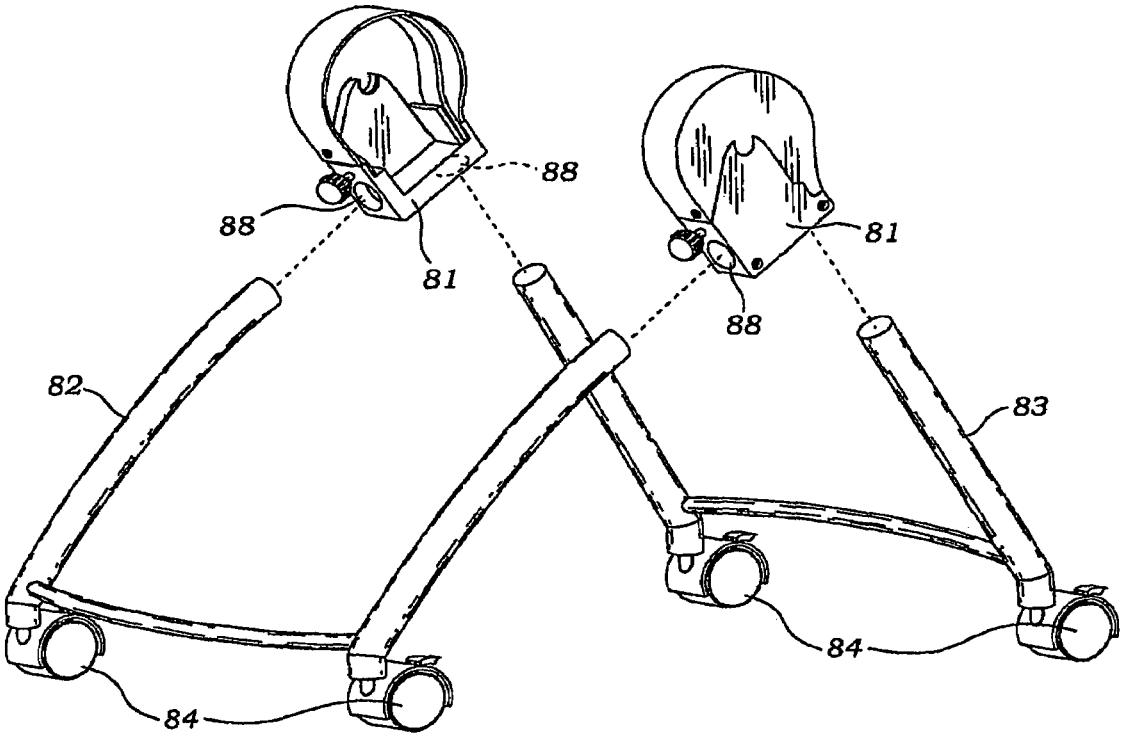
FIG. 8B is an exploded view of a second assembly configuration of the exemplary embodiment of FIG. 1.
Figure 8C:
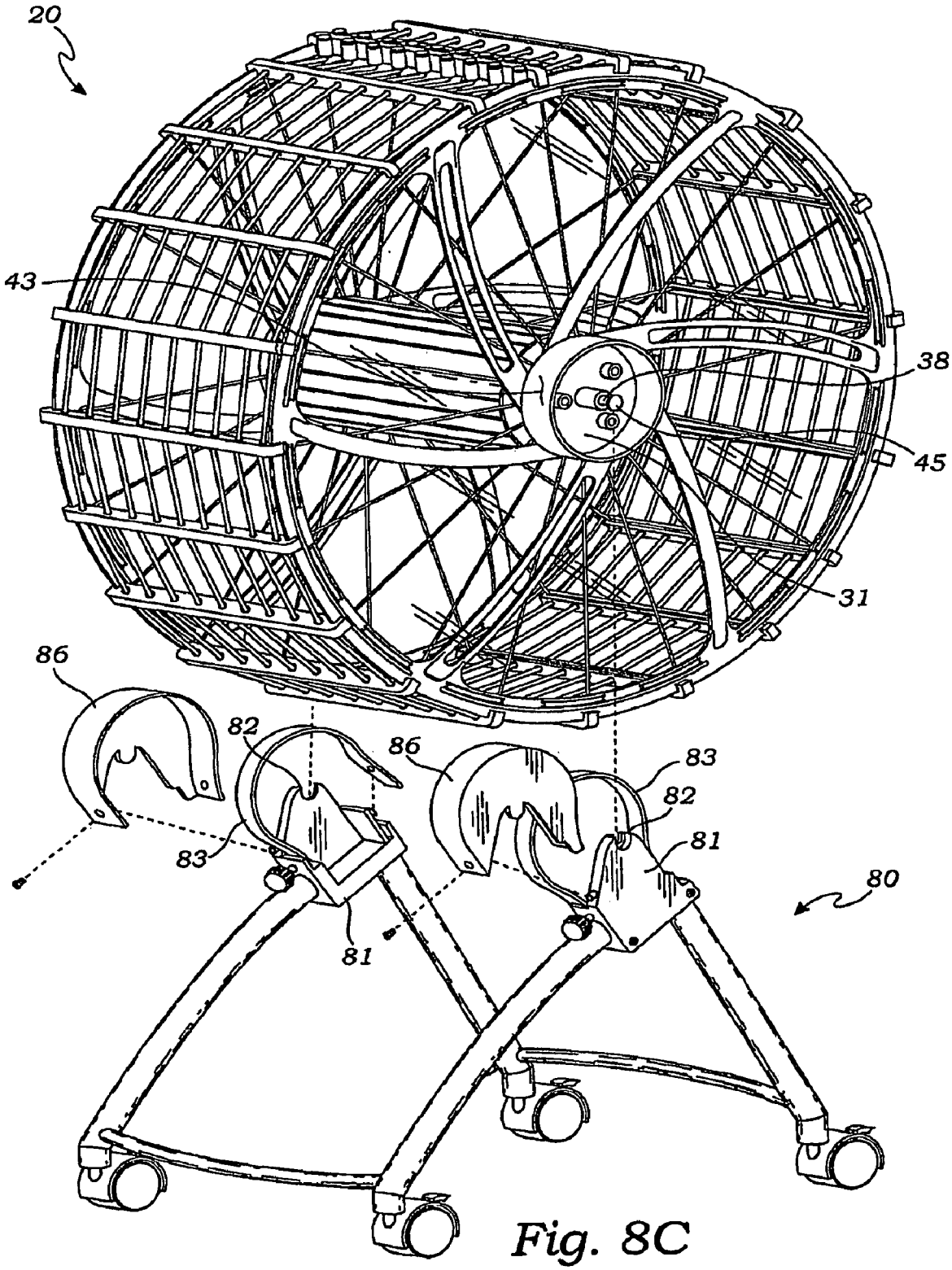
FIG. 8C is an exploded view of a third assembly configuration of the exemplary embodiment of FIG. 1.
Figure 9:
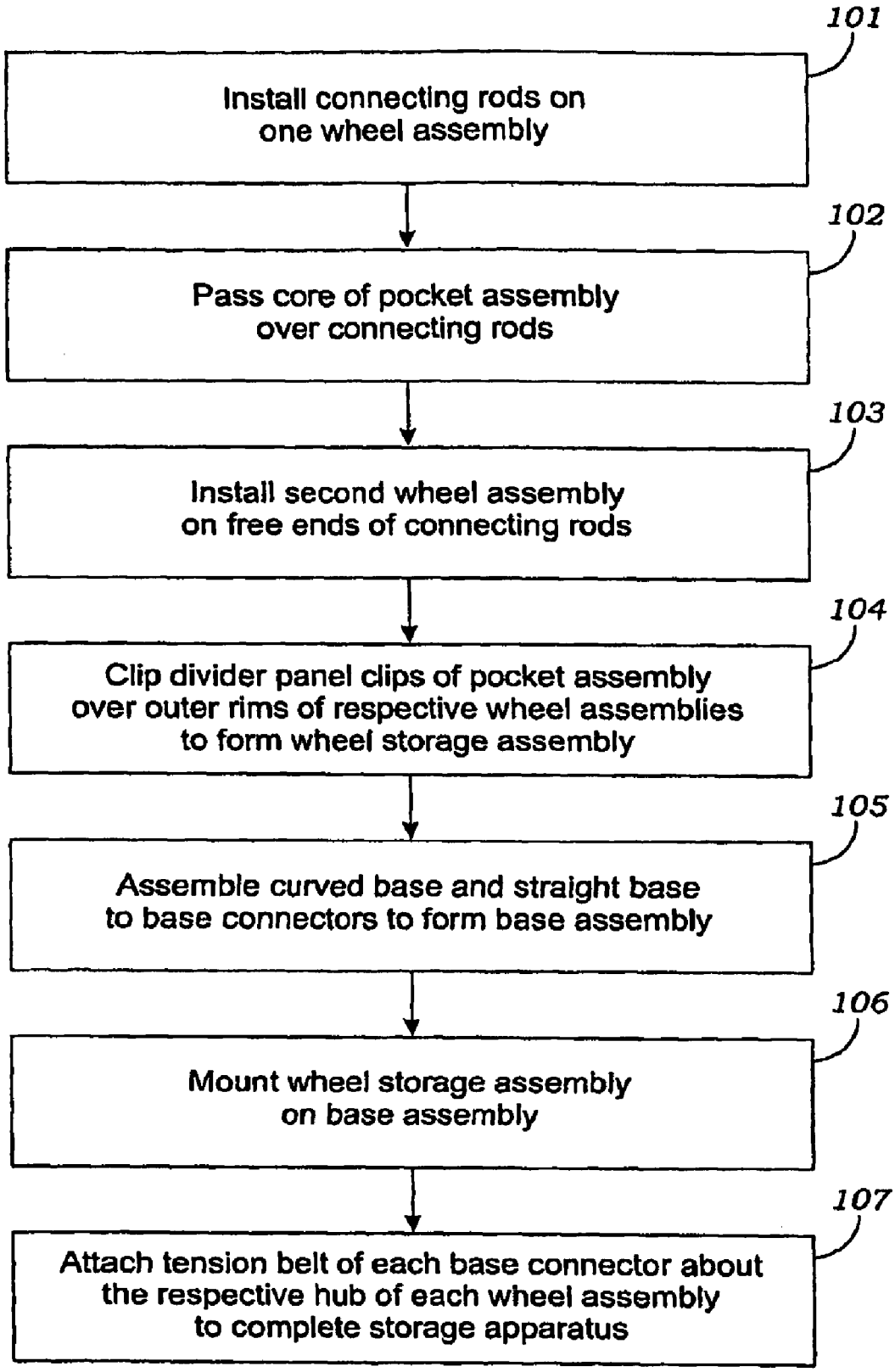
FIG. 9 is a flow chart of the basic assembly steps of the exemplary embodiment of FIG. 1.

Turning then to FIGS. 8A-8C, there are shown exploded perspective views of the wheel storage assembly 20, the base assembly 80, and the final assembly of the storage apparatus 10, respectively. Taken in conjunction with the flow chart of FIG. 9, the general assembly of the exemplary embodiment of the storage apparatus 10 can be understood as explained below. As a threshold matter, it is noted that the assembly description to follow does not include every discrete step to be taken in assembling a storage apparatus 10 according to aspects of the present invention, including not describing, except where discussed elsewhere herein, the manufacturing and assembly steps taken at the factory or with special equipment before the apparatus 10 is acquired by the user for final assembly and use. It will be further appreciated that while certain assembly steps are thus explained in the exemplary embodiment in connection with use by the end-user, greater or lesser numbers of assembly steps may be called out depending on numerous factors, including but not limited to the particular configuration, of the apparatus 10 of the present invention and packaging and shipping considerations. Accordingly, while a specific assembly process is shown and described herein, the present invention is not so limited. Rather, as appreciated from the numerous statements made throughout, while certain means of assembling various ones of the components have been illustrated, numerous other means of assembly now known or later developed as dictated by the mechanical considerations of the geometry and materials of the components are possible without departing from the spirit and scope of the invention. For example, then, it will be appreciated that the storage apparatus 10 may be sold and supplied completely assembled and ready for use as in FIG. 1, in components and sub-assemblies as in the exemplary embodiment of FIGS. 8A and 8B, or entirely in components that must all be assembled prior to use, or any other such combination of steps and scenarios. Referring first to FIG. 8A, with each wheel assembly 30 prefabricated, whether the hub 31, rim 32 and spokes 33 are of a unitary construction or are pre-assembled from two or more components, and with the panel 34 installed on or formed integral with the rim 32, spokes 33 and/or hub 31 in any suitable manner as described above in connection with FIGS. 6A and 6B, the opposing wheel assemblies 30 are then joined by way of the connecting rods 35 passing through the core 51 of the prefabricated pocket assembly 50. First, at step 101, the connecting rods 35 are installed on the hub 31 of one of the wheel assemblies 30, as in the exemplary embodiment by threading screws 36 through lock washers (not shown) and then through corresponding mounting holes in the hub 31 and into threaded holes at the ends of each of the rods 35. At step 102, the core 51 of the pocket assembly 50 is passed over the connecting rods 35. Once more, the pocket assembly 50 may be pre-formed as described above primarily in connection with FIGS. 5, 5A and 5B, including but not limited to the steps of attaching one end of each divider 52 to the core 51 and its opposite free end to the clip 53 and then passing the cords 54 through each of the clips 53 and securing the opposite ends of each cord 54 in any suitable manner, or any one of these steps may instead be left to assembly by the user in readying the storage apparatus 10 for use, again, in large part as dictated by the particular configuration of the apparatus and shipping and packaging concerns. In any event, at step 103, the second wheel assembly 30 is installed parallel to and offset from the first by being mounted in like fashion to the free ends of the connecting rods 35, such that the pocket assembly 50 is then trapped between the two wheel assemblies 30 as suspended on its core 51 about the connecting rods 35. Then, at step 104, the clips 53 of each divider 52 are in turn clipped over the respective rims 32 of the wheel assemblies 30 until all such clips 53, including in the exemplary embodiment the one anchor clip 59, are secured spanning the rims 32 and held in such position in tension by the dividers 52 and the elastic core 51, thereby forming the complete wheel storage assembly 20. The tension of the dividers 52 and thus the pocket assembly 50 mounted on the offset wheel assemblies 30, can be modulated by changing the relative length of the dividers 52 or the diameter of the core 51 or of the rim 32. Turning to FIG. 8B, there is shown the assembly of the base assembly 80. Picking up with step 105 in the flow chart of FIG. 9, the base assembly 80 is essentially formed by assembling the curved base frame 82 and the straight base frame 83 to the respective base connectors 81, though again numerous other configurations and numbers of components are possible in forming the base assembly 80 without departing from the spirit and scope of the invention. In the exemplary embodiment, the base assembly 80 is made up of two tubular base frames 82, 83, each slip-fitted and held in place by collapsing with threaded fasteners 85 partially split sleeves 88 of the base connectors 81. As such, the base frames 82, 83 are detachable from the connectors 81 for disassembly and compact storage. However, once more, it will be appreciated that assembly of the frames 82, 83 to the base connectors 81 can be through numerous other mechanical means now known or later developed, whether temporary or permanent, without departing from the spirit and scope of the invention. Or, in other embodiments the base assembly 80 may be of a single, unitary construction not requiring assembly of legs or frames of any kind. In any event, casters 84 may also be removably or permanently installed in the downwardly-depending portions of the base frames 82, 83 to complete the base assembly 80. Turning to FIG. 8C, there is shown the installation of the wheel storage assembly 20 onto the base assembly 80. With the respective wheel storage assembly 20 and the base assembly 80 so formed, with continued reference to FIG. 8B, in step 106, the wheel storage assembly 20 is rotatably mounted on the base assembly 80, as also shown in FIG. 7, by seating the flanged head 45 of each pin 38 extending axially outwardly from the hubs 31 within the corresponding substantially upwardly opening notch 82 formed on the respective base connector 81. To complete the assembly of the storage apparatus 10 and secure the wheel storage assembly 20 on the base assembly 80, as in step 107, the tension belt 83 installed on each base connector 81 is looped around the outer surface 43 of the respective hub 31 and is secured on the opposite side of the connector 81 as by hooking a hole formed in the free end of the belt 83 over a corresponding hook or post on the connector 81 or by any other removable attachment means now known or later developed. The opposite, fixed end of the belt 83 is installed on the connector 81 in any suitable manner now known or later developed as well, whether during manufacture or during assembly by the end-user, such that either or both ends of the belt 83 may be secured in any manner including but not limited to a threaded fastener such as a screw or bolt, hook-and-loop fasteners, a pin or rivet, a press-, interference- or snap-fit between components of the connector, solvent bonding, welding or ultrasonic welding, stitching, crimping, or the like. Once the belts 83 are so secured about the hubs 31 of the respective wheel assemblies 30, a base cover 86 is installed on each base connector 81 substantially over the hub 31 and tension belt 83 and secured in place by threaded fasteners, snap fit, or any other suitable preferably removable assembly technique now known or later developed in the art. It will be appreciated that certain of these steps can be taken in varying sequences without departing from the spirit and scope of the invention, particularly in the case of alternative embodiments of the construction of the storage apparatus 10. Moreover, even in the exemplary embodiment shown and described, for example, the wheel assemblies 30, once joined together by the connecting rods 35, may then be mounted on the base assembly 80 as shown in FIG. 8C before then concluding the assembly of the storage apparatus 10 by clipping each of the clips 53, 59 over the rims 52 as indicated at step 103. Similarly, the step of assembling the base assembly 80, though indicated at step 104 as occurring after the wheel storage assembly 20 is completed, may instead be executed first before any assembly steps relative to the wheel storage assembly 20 are taken. As such, once more, those skilled in the art will appreciate that the particular assembly steps shown and described in FIGS. 8A-8C and in the flow chart of FIG. 9 are merely illustrative and that the invention is not so limited.

Figure 10:
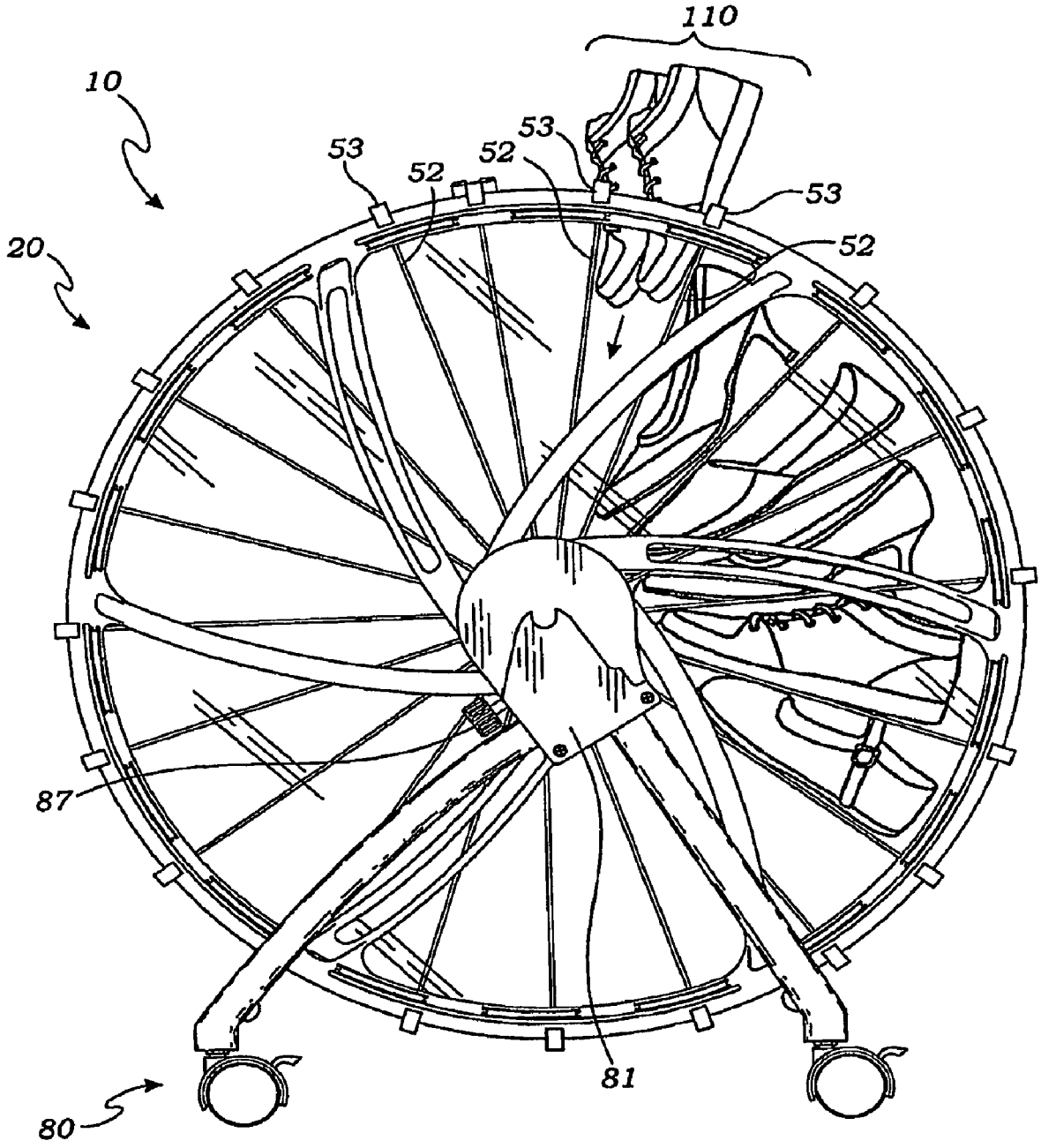
FIG. 10 is a side view of the exemplary embodiment of FIG. 1 in use.
Figure 11:
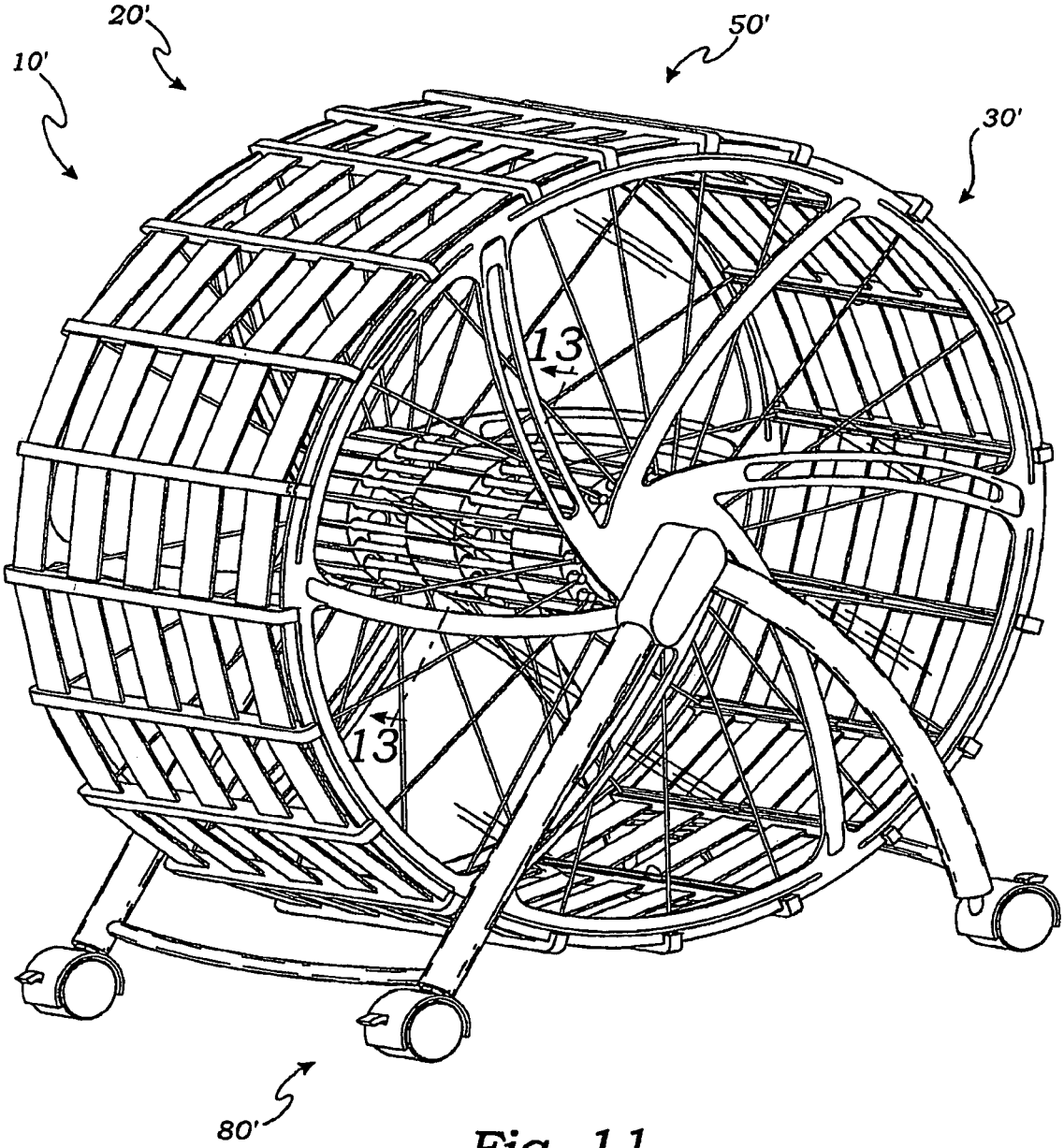
FIG. 11 is a perspective view of an alternative exemplary embodiment of the storage apparatus of the present invention.
Figure 12:
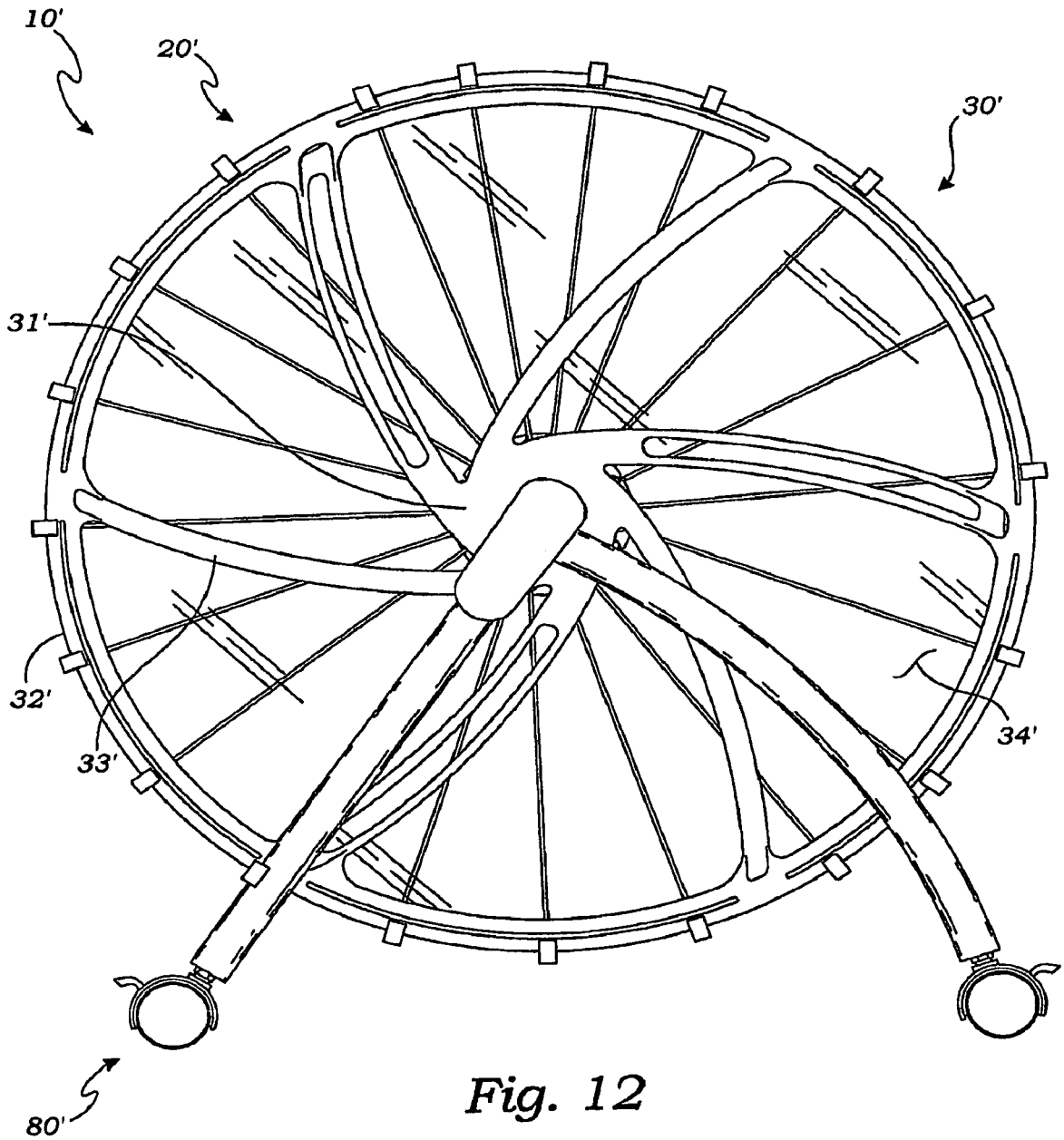
FIG. 12 is side view thereof.

Referring now to FIG. 10, in use, with the storage apparatus 10 so assembled as by rotatably installing the wheel storage assembly 20 onto the base assembly 80 as described above, it will be appreciated that the divider assemblies, and the clips 53, particularly, may be slid circumferentially in either direction along the respective rims 32 of the wheel assemblies 30 so as to thereby adjust the relative positions of the dividers 52 and thus the size of the pockets formed therebetween to accommodate the desired article to be placed therein. In the exemplary embodiment, shoes 110 are stored in each pocket as by inserting the shoes, preferably toe first, into the pocket by passing each shoe between the elastic bands or cords 54 encircling the wheel storage assembly 20 in spaced-apart arrangement. It will be appreciated that such cords 54 are effectively easily parted by the article or object, in this case the shoes 110 being inserted, and that once the shoes 110 have passed entirely into the respective pocket, the cords 54 return to their normal or biased positions, thereby securing the shoes 110 within the pocket of the storage apparatus 10, regardless of the orientation of the pocket within which the shoes 110 are placed as the wheel is rotated to place in or retrieve from the apparatus 10 other shoes or articles. This process is repeated until all the desired shoes or other articles are placed in the storage apparatus 10, whether completely full or not. While not required, it is recommended that shoes be aligned in the same direction as shown in FIG. 10 with the toes closest to the center of the wheel, heels and uppers aligned or stacked pointing in the same clock-wise or counter clock-wise direction. While a single pair of shoes per pocket is also recommended, more can be stored per pocket depending on the size and shape of the shoes. In the exemplary embodiment, it will be appreciated that the storage apparatus can hold at least twenty pairs of shoes 110 corresponding to the twenty pockets formed by the twenty dividers 52 and clips 53. In the event that not all twenty pockets are used, or even if they are but each holds different kinds of articles, such that ultimately the weight is not evenly distributed around the storage apparatus 10, it will be appreciated that the wheel storage assembly 20 could have a tendency to rotate to a position where the weight is concentrated at the bottom, or the center of gravity is closest to the ground. This may undesirable when tying to retrieve a pair of shoes or other articles from this "heavy" side of the apparatus 10. In order to thus control the relative rotation of the storage wheel assembly 20, an adjusting screw 87 threadably installed in the base connector 81 can regulate the tension of the friction belt 83. In the exemplary embodiment, as best seen in FIG. 7, the adjusting screw 87 simply engages a portion of the belt 83 between a secured end and the closest point of contact between the belt 83 and the hub 31 so as to effectively increase or decrease the length of the belt 83, or tighten or loosen the belt 83 as it passes over the hub's outer surface 43. As such, the storage apparatus is then adjusted to the appropriate rotational resistance and is manually rotated during use, remaining static at any desired position on the base assembly 20 by friction if the tension belts 83 are properly adjusted. While a particular means of adjusting the tension on the friction belts 83 is shown and described, it will be appreciated by those skilled in the art that the invention is not so limited and that numerous other mechanical means now known or later developed may be employed without departing from the spirit and scope of the invention. To retrieve a pair of shoes 110 or other article out of the storage apparatus 10, the user manually rotates the wheel storage assembly 20 until it comes to the desired position for the pair of shoes 10 to be taken out. The user will displace the elastic cords 84 by inserting a hand in between them and then pulling out the shoes 110. In an alternative embodiment, the dividers 52 may be constructed as pockets with zippers or as rigid molded shapes such as corresponding to the contour of a shoe or pair of shoes. The dividers 52 and/or clips 53 could also be color-coded for fast identification of shoes or other articles. Again, while shoes 110 are shown in the exemplary embodiment, it will be appreciated that virtually an infinite variety of articles, such as books and magazines, food, and toys, can be conveniently stored in a storage apparatus 10 according to aspects of the present invention. While the storage wheel assembly is shown as being mounted on a base assembly 80 with casters 84, it will be appreciated that the casters 84 can be removed in positioning the storage apparatus 10 in a particular location. Moreover, while the apparatus 10 is shown with the wheel storage assembly 20 oriented substantially vertically on the base assembly 80, the wheel storage assembly 20 may just as easily be in other orientations or not be mounted on the base assembly 80 at all. As such, the apparatus 10 can be stored virtually anywhere around a home, in a closet, under a bed, as by removing the base, or simply as a stand-alone piece of modern furniture. It will be appreciated that each storage pocket automatically or selectively conforms to the size and shape of shoe or other article to be stored. As such, the apparatus 10 is particularly useful when there is a need to store many pairs of shoes or other articles of different sizes and shapes into a very small space or "foot print" that offers immediate viewing of and access to the stored articles. Again, the storage apparatus 10 is completely scalable and can be configured in a variety of overall shapes to suit the variety of items to be stored, from relatively small jewelry items or tools to relatively large toys, for example. When shoes are the intended articles to be stored, specifically, it will be appreciated that the storage apparatus 10 of the present invention can be provided in various sizes to accommodate men's, women's or children's shoes.

Figure 13:
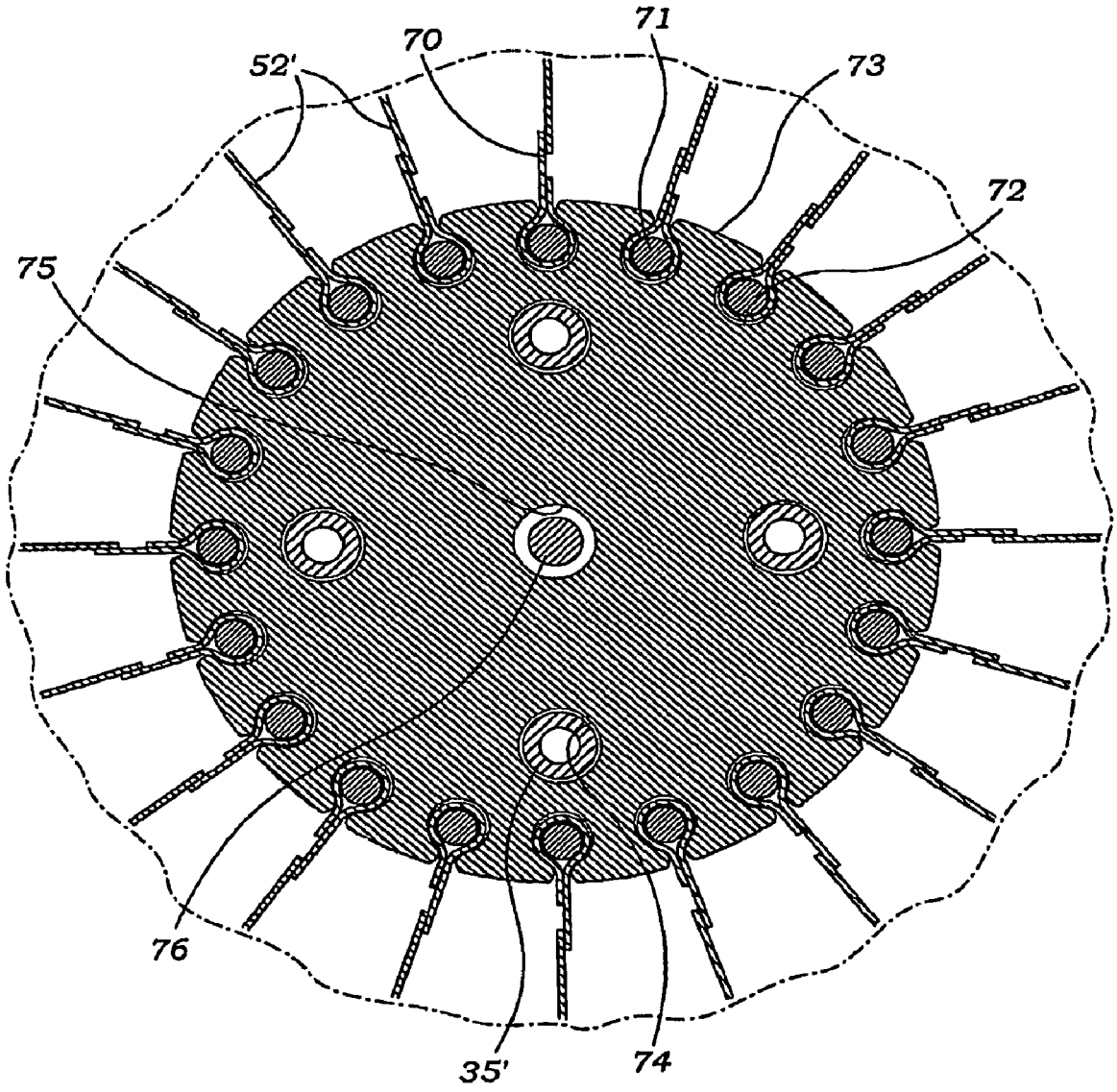
FIG. 13 is a partial, enlarged cross-sectional view thereof taken along line 13-13 of FIG. 11.
Figure 14:
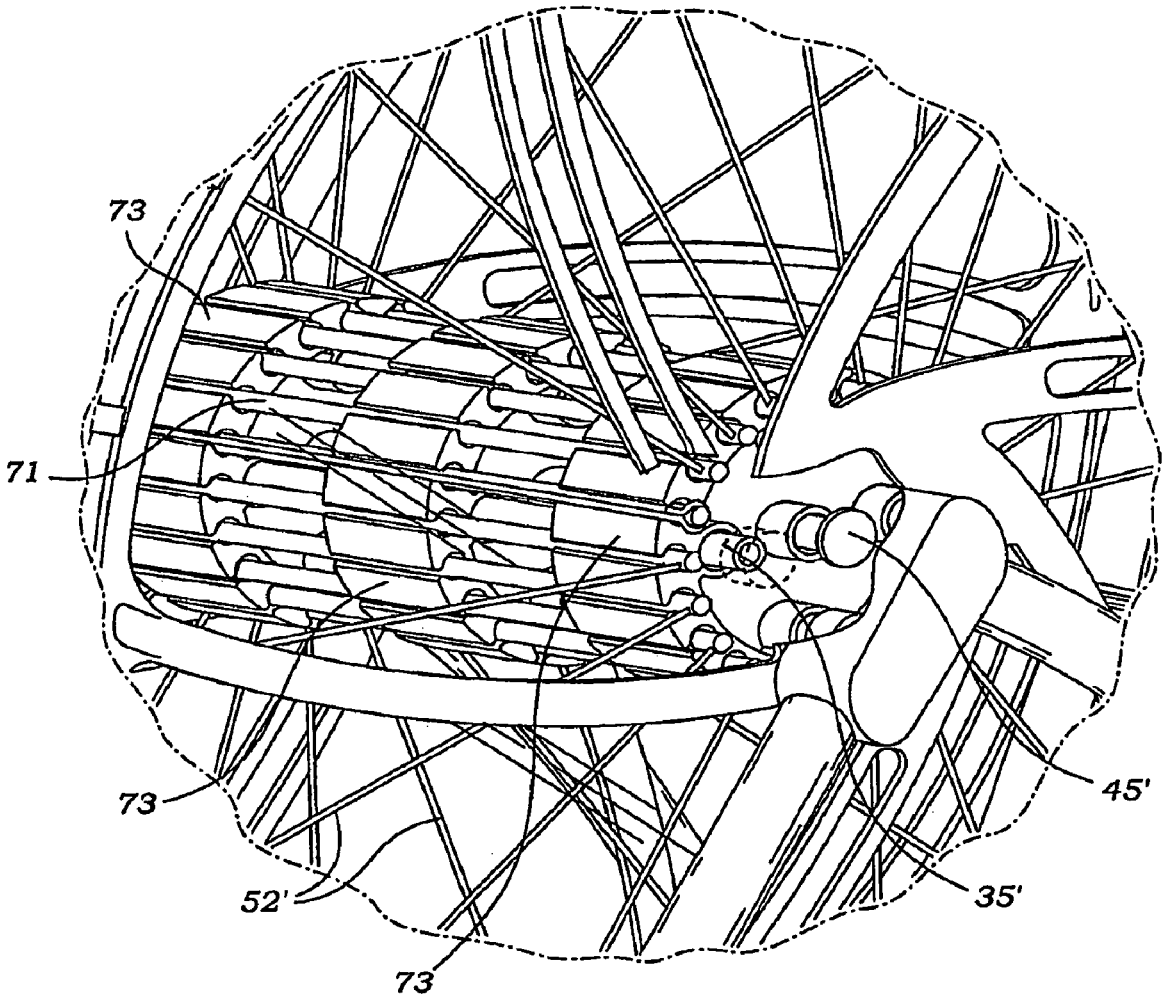
FIG. 14 is a partial, enlarged perspective view thereof.
Figure 15:
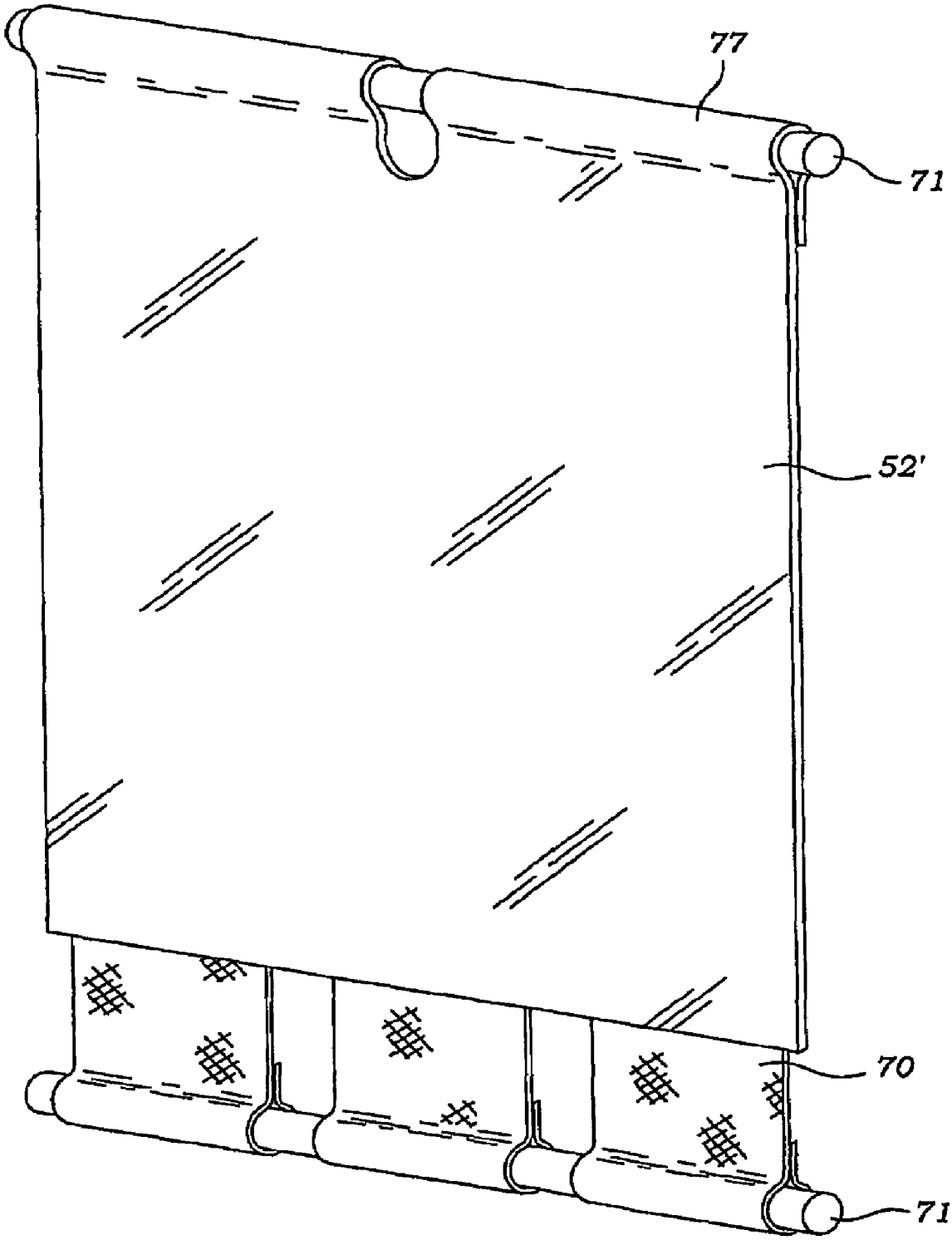
FIG. 15 is a perspective view of a single divider panel construction as employed in the alternative exemplary embodiment of FIG. 11.
Figure 16:
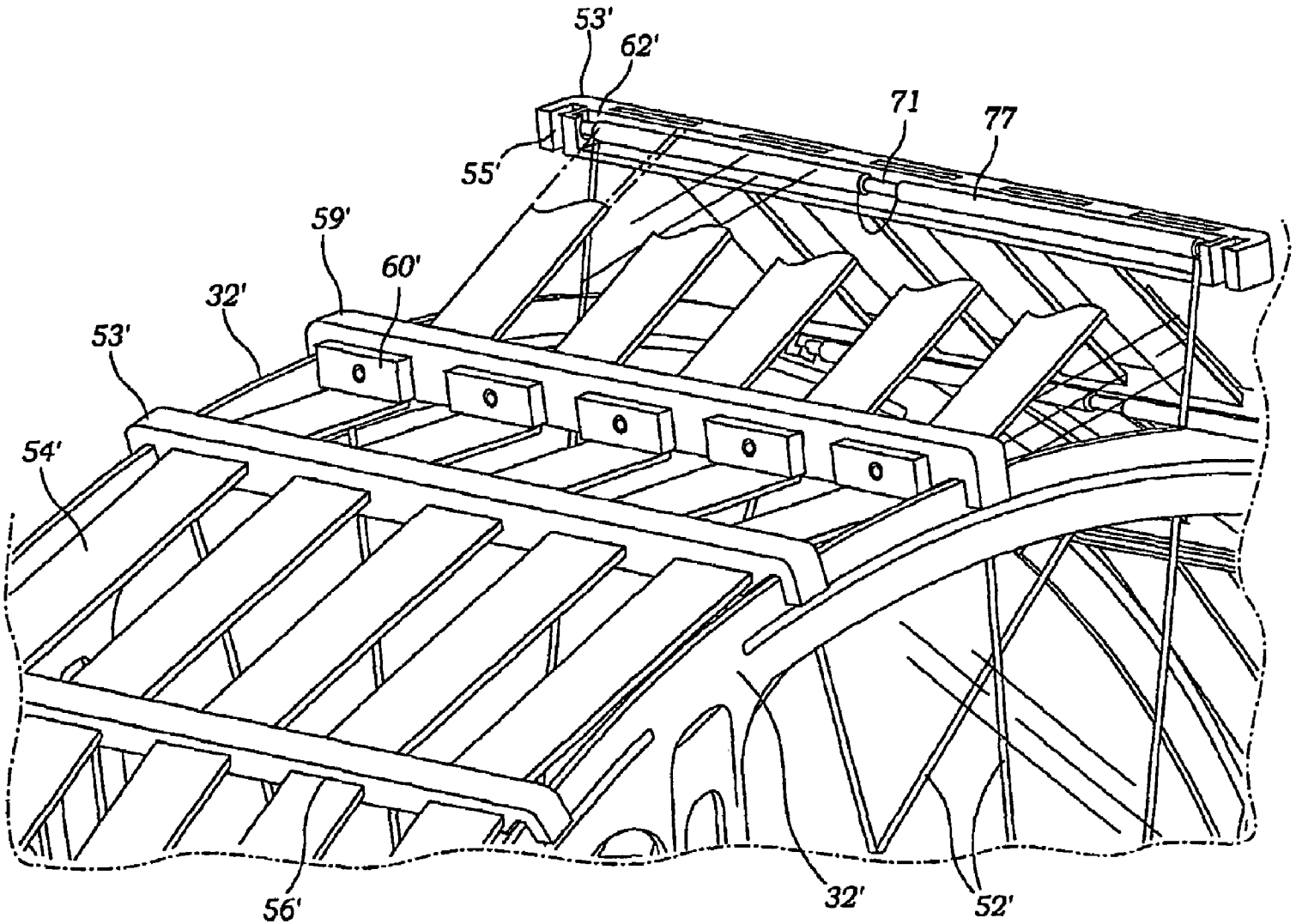
FIG. 16 is a partial, enlarged perspective view of the exemplary embodiment of FIG. 11.

Turning next to FIGS. 11-16, there is shown an alternative exemplary embodiment of the storage apparatus 10' of the present invention. As in the exemplary embodiment of FIGS. 1-10, the storage apparatus 10' generally comprises a base assembly 80' on which is rotatably mounted a wheel storage assembly 20' including a pocket assembly 50' and opposite wheel assemblies 30'. Again, each wheel assembly 30' includes a hub 31' connected to a rim 32' by several spokes 33' and a panel 34' attached to the rim 32'. Regarding the pocket assembly 50', here, as best shown in FIG. 13, at the end closest to the core or hub of the wheel, the dividers 52' are sewn, bonded, welded, or otherwise affixed to elastic loops 70. The loops 70 are passed over dowels 71 that are themselves slid into slots 72 formed on one or more collars 73 that then form the core 51' of the pocket assembly 50. As shown, the lengthwise slots 72 are formed with a somewhat "tear drop" cross-section so as to retain the substantially annular dowels 71 while allowing the captured loops 70 to extend radially outwardly and so be joined with the dividers 52' as described above. The collar 73 is also formed with lengthwise through-holes 74 for the passage therethrough of the connecting rods 35—in this alternative exemplary embodiment four such rods 35 in all. In addition, a central bore 75 is formed in each collar 73 the passage therethrough of an axle rod 76 the ends of which are then seated in the base connectors 81' rather than the over-molded pins 38 of the first exemplary embodiment in rotatably mounting the completed wheel storage assembly 20' on the base assembly 80'. As best shown in FIG. 14 with the hub 31', spokes 33', and the base connector 81' partially cut-away, the ends of the axle rod 76 may still be formed with a flanged tip 45' for seating in a notch of the base connector 81' or the like. With reference now to FIGS. 15 and 16, in the alternative exemplary embodiment, the top end of each divider 52' is folded back and again stitched, bonded, welded or otherwise attached at its free end to itself to form a divider loop 77 through which another dowel 71 is passed for installation within a clip 53'. Specifically, each upper dowel 71 is removably hooked or otherwise secured preferably at its opposite ends within a notch or channel 62' formed substantially along the bottom side of each clip 53'. Here, each clip 53' is formed with a substantially rectangular or slotted through-hole 56' to accommodate the elastic bands or straps 54' employed in the alternative embodiment rather than the cords 54 of FIGS. 1-10. An anchor clip 59' is again employed to secure the opposite free ends of the bands 54', here as by a threadably installed mounting block 60' or the like. It will be appreciated by those skilled in the art that numerous other variations on each of these components and assemblies are possible without departing from the spirit and scope of the present invention. Specifically, it will be appreciated that any of the features of the alternative embodiment of the storage apparatus 10' shown in FIGS. 11-16 may be substituted in or otherwise combined with any of the other alternative exemplary embodiments of the invention as contemplated by the inventor. For example, a core system as shown in FIGS. 11-16 may be combined with a clip and cord system as shown in FIGS. 1-10, or vice versa. In the alternative embodiment of FIGS. 11-16, those skilled in the art will appreciate that elastic loops 70 provide tension on the dividers 52' and clips 53', 59' rather than the elastic core 51 of FIGS. 1-10. Though not shown in any of the exemplary embodiments, it will be appreciated that set screws or the like may be threadably installed in the ends of one or more of the clips 53, 53', 59, 59' to secure any such clip in a particular location about the rims 32, 32'. Again, those skilled in the art will appreciate that numerous other combinations of any of these features are possible in the present invention, such that the exemplary embodiments shown and described are to be understood as merely illustrative of the principles and aspects of the invention.

Figure 17:
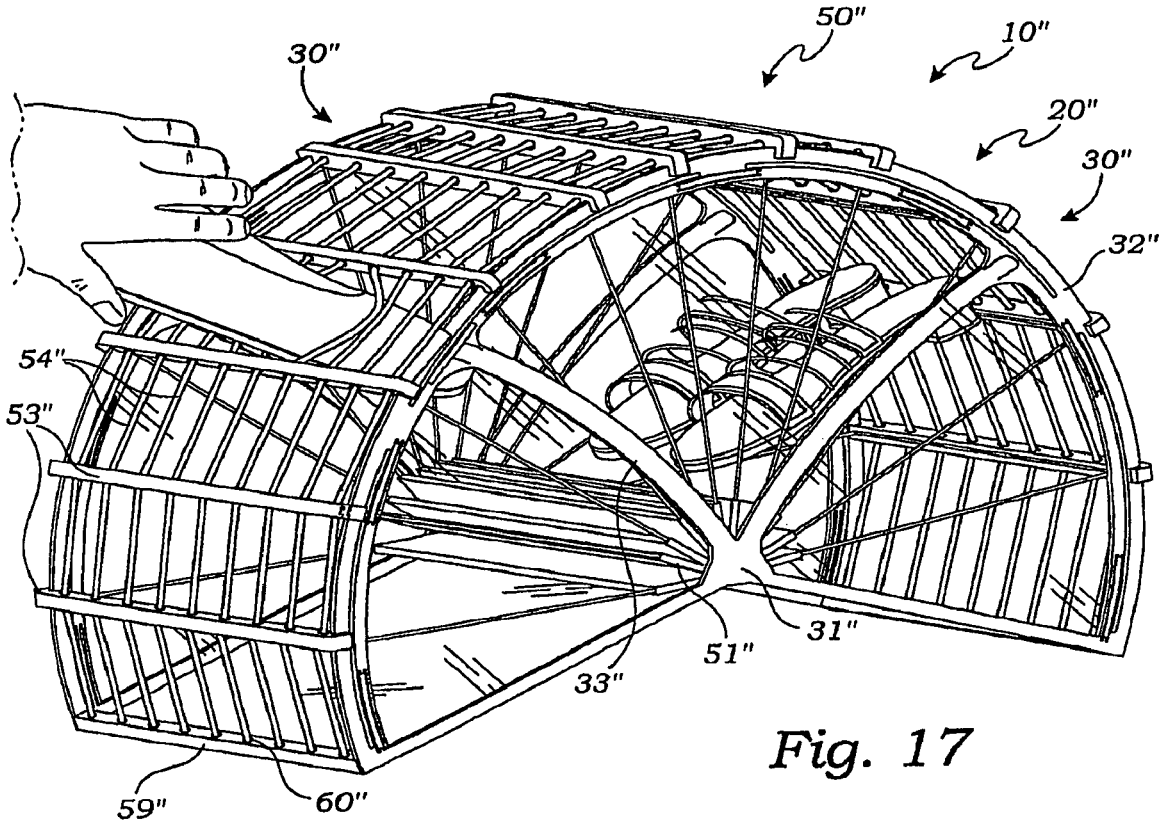
FIG. 17 is a perspective view of an alternative exemplary embodiment of the storage apparatus of the present invention.
Figure 18:
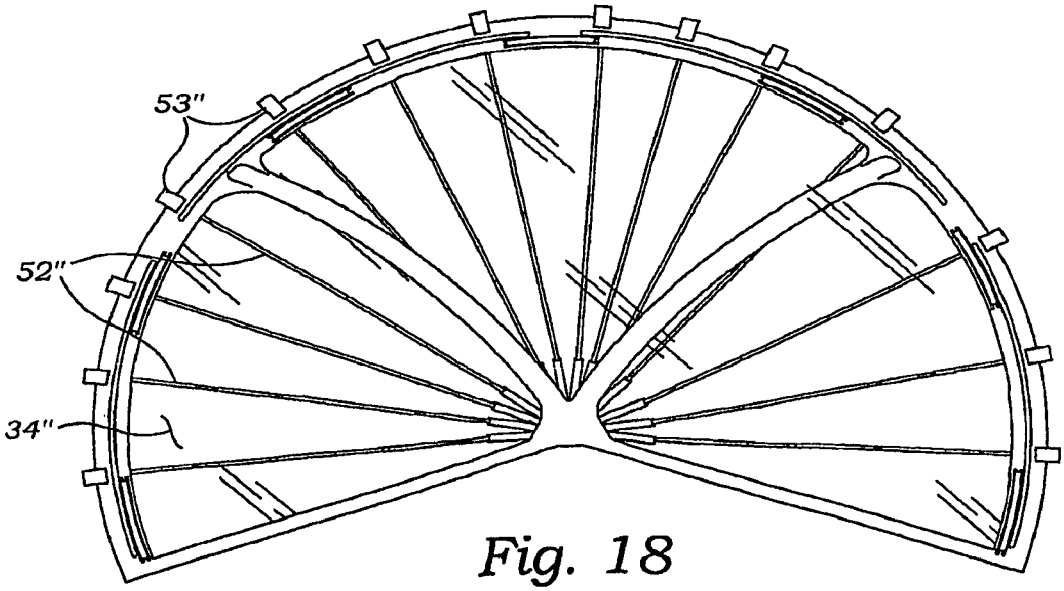
FIG. 18 is a side view thereof.

By way of yet further example, turning now to FIGS. 17 and 18, there is shown an alternative exemplary storage apparatus 10" that is configured as a stand-alone wheel storage assembly 20" not having a separate base assembly. The wheel storage assembly 20" once more generally comprises a pair of wheel assemblies 30' between which is installed a pocket assembly 50". Here, the wheel assemblies 30" are formed as substantially semi-circular rims 32" connected to a hub 31" by two curved spokes 33", again having a clear side panel 34" installed thereon, though this is not required in this or any of the embodiments. The dividers 52" are again installed somewhat in tension between an inner core and outer clips 53", which features can take any form within the spirit and scope of the invention. Here, the dividers 52" extend substantially radially outward from an elastic, fanned core 51". It will be appreciated that because the wheel assemblies 30" do not now form a complete circle as in the previous exemplary embodiments, the cords 54" preferably do not join at opposite ends, though they could along the bottom of the apparatus 10", rendering the anchor clip of the previous embodiments unnecessary. Instead, here the opposite free ends of the cords 54" terminate at and are secured to mounting blocks 59" at opposite circumferential ends of the rims 32" and extending therebetween substantially parallel to the core 51" and the clips 53". Here, the ends of the cords 54" can be secured using any method now known or later developed, including but not limited to knotting the ends of the cords and retaining such knots in counter bored holes 60". Again, those skilled in the art will appreciate that numerous other configurations and combinations of components, assemblies, and features are possible in the storage apparatus of the present invention and that all such exemplary embodiments are merely illustrative. In use, as in the previous embodiments, articles such as shoes 110 may be inserted within the adjustable pockets formed between adjacent dividers 52" by simply displacing or stretching the cords 54" to part them and allow a shoe or shoes or any. other article to be inserted therebetween, as shown in FIG. 17. And as with the prior embodiments, the stand-alone unit 10" shown in FIGS. 17-18 can be placed virtually anywhere around a home or office, such as in a closet, under a bed or other piece of furniture, on a shelf, or simply on the floor. And with any of the exemplary embodiments, any such storage apparatus is easily assembled and disassembled and adjusted to suit a particular storage need. Based on the foregoing, it will be appreciated that while the terms "wheel assembly" and "wheel storage assembly" have been used throughout, the invention is not limited to a continuous or even a round wheel as those terms are typically understood. Rather, a virtually infinite variety of shapes and configurations of the pocket assembly and the rim on which it is suspended are possible in the present invention. Such other structure and resulting benefits of operation are thus possible without departing from the spirit and scope of the invention.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor believes that the claimed subject matter is the invention.

What is claimed is:

1. A storage apparatus comprising:

a base assembly; and a wheel storage assembly mounted on the base assembly for storage therein of an article, the wheel storage assembly comprising:

a pocket assembly comprising a core, at least two offset dividers projecting substantially radially outwardly from the core to form a free end of each divider, and a clip mounted at the free end of each divider; and a pair of wheel assemblies installed in offset and substantially parallel relationship about the pocket assembly, whereby each clip slidably engages each wheel assembly so as to selectively position the respective divider during use of the apparatus.

2. The apparatus of claim 1, wherein the base assembly comprises:

a pair of base connectors; and a pair of frames removably mounted on the pair of connectors.

3. The apparatus of claim 2, wherein each frame further includes two casters.

4. The apparatus of claim 1, wherein:

the clip is formed with at least one through-hole; and a cord passes through each through-hole to selectively contain the article within a pocket formed by adjacent dividers.

5. The apparatus of claim 4, wherein:

the core is formed from an elastic material;

the pocket assembly is configured with multiple dividers extending radially outwardly from the core, each divider being formed substantially at its free end with a divider hole;

multiple clips are mounted at the free ends of the dividers in an offset, substantially parallel arrangement, each clip being configured with a lengthwise slot extending substantially centrally through the clip up from its bottom so as to at least intersect each through-hole;

the free end of each divider is inserted in the slot of each clip such that the divider hole is substantially aligned with the respective through-hole of the clip; and the cord is formed from an elastic material and passes through the through-hole and the divider hole of each assembly of a divider and a clip, whereby each divider is retained in its respective clip and the clips are slidable along the rims and held in place by the cord in cooperation with the elastic core providing tension on the dividers.

6. The apparatus of claim 5, wherein:

the wheel assemblies are substantially circular; and each cord is secured at its opposite free ends in an anchor clip so as to form a substantially continuous loop about the pocket assembly.

7. The apparatus of claim 6, wherein the anchor clip comprises:

offset side holes;

at least one cross-hole intersecting each side hole; and a screw inserted in each cross-hole to selectively secure the free end of each cord inserted in the respective side hole.

8. The apparatus of claim 6, wherein the anchor clip comprises:

offset side holes counter bored from the top so as to have a stepped flange substantially at the bottom of each side hole;

a single cross-hole intersecting each side hole and the slot; and a cross-pin inserted into the cross-hole and the divider hole of a divider inserted into the slot, whereby the divider is retained in the slot by the cross-pin and the free end of each cord is passed into each side hole and then knotted so as to be retained against the respective flange.

9. The apparatus of claim 1, wherein each wheel assembly comprises:

a hub; and a rim attached to the hub.

10. The apparatus of claim 9, wherein the rim is attached to the hub through at least one substantially radial spoke.

11. The apparatus of claim 9, wherein a panel is attached to the rim so as to substantially span the hub and the rim.

12. The apparatus of claim 11, wherein:

the rim is formed with spaced-apart slots thereabout; and the panel is formed with spaced-apart radially-outwardly extending tabs substantially corresponding to the slots and configured to pass through at least one slot so as to secure the panel on the rim.

13. The apparatus of claim 12 wherein the tabs are secured after passing through the at least one slot by means selected from the group consisting of a high frequency weld, an ultrasonic weld, a tack weld, a solvent bond, a stitch, a crimp, a screw, a hook-and-loop fastener, and a snap.

14. The apparatus of claim 9 further comprising at least one connecting rod joining the two wheel assemblies, the connecting rod passing through the core of the pocket assembly.

15. The apparatus of claim 14 wherein each hub comprises:

a mounting hole configured to receive an end of the connecting rod; and an outwardly-extending pivot pin configured to seat in a substantially upwardly-opening notch of a base connector of the base assembly so as to rotatably mount each wheel assembly on the base assembly.

16. The apparatus of claim 15 wherein:

each hub is configured with an outwardly-extending boss; and the pivot pin is formed with a notched shoulder onto which the boss is over-molded, whereby the pivot pin is effectively formed integral with hub.

17. The apparatus of claim 9, wherein:

each hub is formed with an outer, substantially rounded surface; and a tension belt is installed on a base connector of the base assembly and looped around the rounded surface, whereby the belt controls rotational speed of the wheel storage assembly as mounted on the base assembly and keeps the wheel storage assembly nested in place on the base assembly.

18. The apparatus of claim 17 wherein an adjusting screw is threadably installed in the base connector so as to selectively engage the belt, whereby adjustment of the adjusting screw adjusts the tension of the belt on the rounded surface.

19. A storage apparatus comprising:

a pair of wheel assemblies installed in offset and substantially parallel relationship, each wheel assembly having a rim; and a pocket assembly installed substantially between the offset wheel assemblies, the pocket assembly having a core, at least two dividers extending from the core to form a free end of each divider, and a clip mounted at the free end of each divider and configured to slidably engage the rim of each wheel assembly so as to selectively position the respective divider during use of the apparatus.

20. A storage apparatus comprising:

a pocket assembly having an elastic core, at least two dividers extending substantially radially outwardly from the core to form a free end of each divider having a divider hole formed therein, a clip mounted at the free end of each divider having a through-hole substantially aligned with the divider hole, and at least one elastic cord passing through the divider hole and the through-hole, whereby each divider is retained in its respective clip; and a pair of wheel assemblies installed in offset and substantially parallel relationship about the pocket assembly, each wheel assembly having a rim on which each clip is slidably and removably received, whereby the clips are slidable along the rims, as held in place by the cord in cooperation with the elastic core providing tension on the dividers, so as to selectively position the respective divider during use of the apparatus.

21. A method of storing articles, comprising the steps of:

sliding a clip along offset rims to adjust the size of a pocket formed between adjacent dividers attached to adjacent ones of the clip;

displacing at least one cord passing through the clips; and inserting an article into the pocket by passing the article by the displaced cord.

22. The method of claim 21, comprising the further step of rotating a wheel storage assembly, the wheel storage assembly being formed by assembling a pocket assembly including the clip and the dividers onto offset wheel assemblies including the rims so as to slidably attach the clip across adjacent rims and thereby suspend the pocket assembly on the wheel assemblies to form the wheel storage assembly.

23. The method of claim 21, comprising the further step of rotatably mounting the wheel storage assembly on a base assembly.

24. The method of claim 23, comprising the further step of adjusting a tension belt formed on a base connector of the base assembly and configured to loop over a hub of the wheel assembly so as to adjust the rotational speed of the wheel storage assembly as mounted on the base assembly.

* * * * *